US007805775B2

(12) United States Patent
Ikeda

(10) Patent No.: US 7,805,775 B2
(45) Date of Patent: Oct. 5, 2010

(54) NECK COVER FOR FULL FACE TYPE HELMET AND FULL FACE TYPE HELMET

(75) Inventor: Yoshiyuki Ikeda, Ryugasaki (JP)

(73) Assignee: Shoei Co., Ltd. (JP)

( * ) Notice: Subject to any disclaimer, the term of this patent is extended or adjusted under 35 U.S.C. 154(b) by 1321 days.

(21) Appl. No.: 10/562,192

(22) PCT Filed: Sep. 10, 2004

(86) PCT No.: PCT/JP2004/013208

§ 371 (c)(1),
(2), (4) Date: Dec. 22, 2005

(87) PCT Pub. No.: WO2005/120264

PCT Pub. Date: Dec. 22, 2005

(65) Prior Publication Data

US 2006/0195973 A1 Sep. 7, 2006

(30) Foreign Application Priority Data

Jun. 7, 2004 (JP) ..... 2004-168597

(51) Int. Cl.
*A42B 3/00* (2006.01)

(52) U.S. Cl. ..... 2/415; 2/411

(58) Field of Classification Search ..... 2/410–412, 2/415, 424

See application file for complete search history.

(56) References Cited

U.S. PATENT DOCUMENTS

| | | | | |
|---|---|---|---|---|
| 3,039,108 | A * | 6/1962 | Lohrenz | 2/412 |
| 3,189,917 | A * | 6/1965 | Sims | 2/415 |
| 3,562,813 | A * | 2/1971 | Origer | 2/410 |
| 3,958,275 | A * | 5/1976 | Morgan et al. | 2/421 |
| 4,581,774 | A * | 4/1986 | Chaise | 2/421 |
| 4,598,430 | A * | 7/1986 | Nava | 2/410 |
| 4,796,309 | A | 1/1989 | Nava | |
| 4,881,529 | A * | 11/1989 | Santos | 2/468 |
| 5,095,550 | A * | 3/1992 | Perlinger | 2/422 |
| 5,208,514 | A * | 5/1993 | Bassick | 318/560 |
| 5,412,810 | A | 5/1995 | Taniuchi | |
| 5,946,719 | A * | 9/1999 | Crupi et al. | 2/6.5 |
| 6,289,521 | B1 * | 9/2001 | Ikeda | 2/421 |
| 2009/0222977 | A1 * | 9/2009 | Arai | 2/415 |

FOREIGN PATENT DOCUMENTS

| | | |
|---|---|---|
| DE | 8012111 | 7/1980 |
| DE | 3419302 | 11/1985 |
| EP | 1391158 | 2/2004 |

* cited by examiner

*Primary Examiner*—Shaun R Hurley
*Assistant Examiner*—Andrew W Sutton

(57) ABSTRACT

A neck cover (51) includes a flexible cover member (53) and a to-be-attached portion (52) which serves to attach the flexible cover member (53) to a head protecting body (3) of a full-face-type helmet (1). The flexible cover member (53) comprises a substantially plate-like flexible cushion member (56) and a flexible support member (57) which supports the flexible cushion member (56). The flexible cover member (53) is mainly made of a substantially plate-like foamed synthetic resin, a permeability of which measured by using a Frajour type method based on JIS L 1096 falls within a range of 0.1 to 10 cc/cm$^2$·sec (preferably 0.2 to 5 cc/cm$^2$·sec and more preferably 0.3 to 2 cc/cm$^2$·sec).

Therefore, a sound which is generated by a traveling wind as it is caught in a ventilator, stabilizer, or the like is effectively prevented from being heard as loud noise to a helmet wearer.

26 Claims, 16 Drawing Sheets

NECK COVER FOR FULL FACE TYPE HELMET AND FULL FACE TYPE HELMET

TECHNICAL FIELD

The present invention relates to a full-face-type helmet neck cover which is configured to be attached to near a lower end of a head protecting body of a full-face-type helmet to cover the vicinity of the neck of a helmet wearer. The present invention also relates to a full-face-type helmet with a neck cover which uses this neck cover, and a full-face-type helmet with a chin cover and a neck cover (to be referred to as a "full-face-type helmet with a chin cover/neck cover" in this specification) which use this neck cover.

BACKGROUND ART

A full-face-type helmet neck cover as described above is described in U.S. Pat. No. 6,308,343B1. The neck cover described in this patent reference includes a substantially U-shaped elastic to-be-attached member which serves as an elastic shape holding member, a substantially U-shaped flexible cover member which is attached to the elastic to-be-attached member and made of urethane foam, and a pair of left and right locking means which are attached to the left and right front ends of the flexible cover member. The pair of left and right locking means are used to lock the distal ends of the left and right front ends of the flexible cover member with cheek inside members, a head inside member, or an outer shell while the left and right ends are bent upward to extend substantially in L-letter shapes from the lower end face to the front end face of the cheek inside member. When the neck cover is to be attached to a full-face-type helmet, the elastic to-be-attached member is inserted between the outer shell, and the head inside member and cheek inside members. Thus, the flexible cover member is disposed to cover the rear portion and left and right side portions of the neck of the helmet wearer. The pair of left and right locking members are locked by the cheek inside members, the head inside member, or the outer shell.

When a helmet wearer puts the full-face-type helmet with the neck cover obtained in this manner on his or her head and rides a motorbike, a traveling wind is prevented by the neck cover to a certain degree from entering the head accommodating space of the helmet through the gap between the lower ends of the head inside member and cheek inside members of the helmet, and around the neck of the helmet wearer. Also, a sound which is generated by the traveling wind as it is caught in the ventilator, stabilizer, or the like of the helmet is prevented to a certain degree from entering the head accommodating space in the same manner.

A full-face-type helmet chin cover which is configured to be attached to a full-face-type helmet to cover the vicinity of the chin of the helmet wearer is described in U.S. Pat. No. 5,412,810. The chin cover described in this patent reference is formed of an elastic to-be-attached member which serves as an elastic shape holding member, and a flexible cover member which is made of mesh cloth and attached to the elastic to-be-attached member. When the chin cover is to be attached to the full-face-type helmet, the elastic to-be-attached member is inserted between an outer shell and an impact-on-the-chin-and-cheek absorbing liner. Thus, the flexible cover member is disposed to cover the vicinity of the chin of the helmet wearer from below.

When the helmet wearer puts the full-face-type helmet with the chin cover obtained in this manner on his or her head and rides a motorbike, a traveling wind which blows the chest of the helmet wearer and is directed toward the chin is prevented by the flexible cover member to a considerable degree. Hence, the traveling wind is prevented to a certain degree from entering the head accommodating space of the helmet through the gap between the lower end of the chin cover of the helmet and the chin of the helmet wearer. Also, a sound which is generated by the traveling wind as it is caught in the ventilator, the stabilizer, or the like of the helmet is prevented to a certain degree from entering the head accommodating space through the gap between the lower end of the inside member of the helmet and around the neck of the helmet wearer.

Recently, the structure of an air supply ventilator, an air exhaust ventilator, or an air supply/exhaust ventilator, an air flow straightening stabilizer, or the like attached to the outer shell of a full-face-type helmet has become complicated and bulky. Accordingly, the volume of the sound which is generated by a traveling wind as it is caught in such a ventilator or a stabilizer has become particularly large. The sound of the caught-in traveling wind is heard as large noise even to the helmet wearer who wears the known full-face-type helmet with the neck cover on his head.

In particular, urethane foam which is used as the material of the flexible cover member of the known full-face-type helmet with the neck cover is basically formed of open cell bodies for the sake of flexibility and accordingly has comparably large permeability. When the sound of the caught-in traveling wind is particularly large, it is heard as loud noise to the helmet wearer partly because the urethane foam is comparatively thin.

The present inventor thought out forming a full-face-type helmet with a chin cover/neck cover by attaching the chin cover of the known full-face-type helmet with the chin cover as described above to the known full-face-type helmet with the neck cover as described above. Even with the full-face-type helmet with the chin cover/neck cover, the caught-in traveling wind is heard as particularly loud noise to the helmet wearer in the same manner as with the known full-face-type helmet with the neck cover.

In view of this, the present inventor attempted to change the material of the flexible cover member of the chin cover of the full-face-type helmet with the chin cover/neck cover from mesh cloth having good permeability to a flexible foamed synthetic resin which does not have good permeability. With the full-face-type helmet with the chin cover/neck cover made of the flexible foamed synthetic resin, a traveling wind which blows the chest of the helmet wearer and is directed toward the chin of the helmet wearer and other traveling winds are interrupted to a considerable degree by the flexible cover member of the chin cover and the flexible cover member of the neck cover. Then, the inner surface of the shield plate tends to be fogged easily, and the helmet wearer can hardly hear the external voice and sound.

The present invention aims at effectively correcting the above drawbacks of the known full-face-type helmet with the neck cover and the two types of full-face-type helmets with the chin cover/neck cover as described above with a comparatively simple structure.

DISCLOSURE OF INVENTION

According to the first aspect of the present invention, there is provided a full-face-type helmet neck cover which is configured to be attached to near a lower end of a head protecting body of a full-face-type helmet, characterized by comprising a flexible cover member and a to-be-attached portion which serves to attach the flexible cover member to the head protecting body, the flexible cover member comprising a substantially plate-like flexible cushion member which is mainly made of a substantially plate-like foamed synthetic resin, and a flexible support member which supports the cushion member, wherein a permeability of the foamed synthetic resin measured by using a Frajour type method based on JIS L 1096 falls within a range of 0.1 to 10 $cc/cm^2 \cdot sec$ (preferably 0.2 to 5 $cc/cm^2 \cdot sec$ and more preferably 0.3 to 2 $cc/cm^2 \cdot sec$).

JIS L 1096 described above stands for Japanese Industrial Standards "L 1069". According to the Frajour type method (i.e., method A in JIS L 1096), five test samples each having a size of about 20 cm×20 cm are extracted from different portions of a sample. Using a predetermined Frajour type testing machine, each test sample is attached to one end of a cylinder. The suction fan is adjusted by a rheostat such that an inclination type barometer exhibits a pressure of 125 Pa {1.27 $cmH_2O$}. The quantity ($cm^3/cm^2 \cdot sec$) of air that passes through the test sample is obtained from the pressure indicated by a vertical barometer and the type of the employed air hole by referring to a table attached to the Frajour type testing machine. Measurement is performed five times. An average value is calculated and rounded to the first decimal place. In the Frajour type testing machine, the inner cylinder has a mass of 142 g, and the test sample clamp plate has an effective area of 64 $mm^2$ (diameter of aperture: 9 mm). In an appropriate case, the Frajour type testing machine has a predetermined structure with an outer cylinder (height: 254 mm, inner diameter: 82.6 mm), an inner cylinder (height: 254 mm, outer diameter: 76.2 mm, inner diameter: 74 mm, and mass: 567 g) and a test sample clamp plate with an effective area of 642 $mm^2$ (diameter of aperture: 28.6 mm).

According to the first aspect of the present invention, preferably, the flexible support member is made of a substantially non-permeable sheet-type material such as an artificial leather sheet, and the flexible support member covers the flexible cushion member substantially entirely like a bag. Preferably, a density of the foamed synthetic resin falls within a range of 20 to 80 $kg/m^3$ (more preferably 25 to 70 $kg/m^3$, and most preferably 30 to 60 $kg/cm^3$). Preferably, an average thickness of the flexible cushion member falls within a range of 4 to 18 mm (preferably 6 to 12 mm). Preferably, the foamed synthetic resin comprises urethane foam. The flexible cushion member can be made of only a foamed synthetic resin.

According to the first aspect of the present invention, the to-be-attached portion comprises a substantially plate-like elastic to-be-attached member which serves as a shape holding member as well, and the flexible cover member attached to the to-be-attached member serving as the shape holding member is held in a substantially predetermined shape by the to-be-attached member serving as the shape holding member. The flexible cover member can have a substantially annular shape with a missing portion which corresponds to substantially the central portion of the front portion of the head protecting body. The missing portion can comprise an intermittent portion, so that the left and right ends of the flexible cover member can be present on the left and right sides of the intermittent portion, respectively. The to-be-attached portion can have a substantially annular shape with a missing portion which corresponds to substantially a central portion of a front portion of the head protecting body.

According to the second aspect of the present invention, there is provided a full-face-type helmet with a neck cover, characterized by comprising a full-face-type helmet and a full-face-type helmet neck cover according to the first aspect which is configured to be attached to near a lower end of a head protecting body of the full-face-type helmet.

According to the second aspect of the present invention, preferably, the full-face-type helmet comprises a neck pad attached to near the lower end of the head protecting body, the neck pad comprises a thin plate-like second flexible cushion member and a second flexible support member which supports the second flexible cushion member, the second flexible support member is attached to the head protecting body, and in an attached state wherein the neck cover is attached to near the lower end of the head protecting body, the flexible cover member of the neck cover covers the neck pad at least partially from substantially below. Preferably, the to-be-attached portion of the neck cover is inserted between the inner surface of the outer shell of the head protecting body and an outer surface of a backing member of the head protecting body substantially upward from substantially below to attach the neck cover to the head protecting body. In an attached state wherein the neck cover is attached to the head protecting body, preferably, the proportion of the area of the flexible cover member in the area of a lower opening of an outer shell of the head protecting body falls within a range of 38% to 88% (more preferably 48% to 74%), in the above attached state, a proportion of a circumferential length of the flexible cover member along a circumference of the lower opening in a circumferential length of the lower opening falls within a range of 70% to 94% (more preferably 80% to 90%), and in the above attached state, a proportion of an inner circumferential length of the flexible cover member to an outer circumferential length of the flexible cover member falls within a range of 58% to 94% (more preferably 70% to 88%).

According to the third aspect of the present invention, there is provided a full-face-type helmet with a chin cover/neck cover comprising a full-face-type helmet according to the second aspect, a full-face-type helmet neck cover according to the first aspect or the first and second aspects which is configured to be attached to near a lower end of a head protecting body of the full-face-type helmet, and a full-face-type helmet chin cover which is configured to be attached to near the lower end of the head protecting body, characterized in that the flexible cover member of the neck cover has a missing portion which corresponds to substantially a central portion of a front portion of the head protecting body, the chin cover comprises a second flexible cover member having a porous, permeable flexible cover main body, and a second to-be-attached portion which serves to attach the second flexible cover member to near the lower end of the head protecting body, and in an attached state wherein both the neck cover and the chin cover are attached to near the lower end of the head protecting body, the neck cover overlaps both left and right ends of the chin cover, and at the missing portion, the substantially central portion of the second flexible cover member of the chin cover does not overlap the flexible cover member of the neck cover.

According to the third aspect of the present invention, preferably, the flexible cover main body of the second flexible cover member is made of mesh cloth. Preferably, the missing portion comprises an intermittent portion, and in an attached state wherein both the neck cover and the chin cover are attached to near the lower end of the head protecting body, left and right ends of the neck cover respectively overlap left and right ends of the chin cover. Preferably, the second to-be-attached portion comprises a substantially plate-like elastic second to-be-attached member which also serves as a second shape holding member, and the second flexible cover member attached to the second to-be-attached member which also serves as the second shape holding member is held in a substantially predetermined shape by the second to-be-attached member which also serves as the second shape holding member. The second flexible cover member can have a wide, substantially crescent-like shape which is substantially close to a half moon. The second flexible cover member can comprise the flexible cover main body and a flexible rim member attached to the flexible cover main body. Preferably, the second to-be-attached portion of the chin cover is inserted between the inner surface of an outer shell of the head protecting body and an outer surface of a backing member of the head protecting body substantially upward from substantially below to attach the chin cover to the head protecting body.

According to the third aspect of the present invention, preferably, in an attached state wherein the chin cover is attached to the head protecting body, a proportion of an area of the second flexible cover member in an area of a lower opening of an outer shell of the head protecting body falls within a range of 14% to 34% (more preferably 18% to 28%), and in the above attached state, a proportion of a circumferential length of the second flexible cover member along the circumference of the lower opening in a circumferential length of the lower opening falls within a range of 28% to 52% (more preferably 34% to 46%). Preferably, in the attached state wherein the chin cover is attached to the head protecting body, a proportion of an area of the flexible cover main body of the second flexible cover member in an area of a lower opening of an outer shell of the head protecting body falls within a range of 8% to 26% (more preferably 12% to 22%), and in the above attached state, a proportion of a circumferential length of the flexible cover main body along a circumference of the lower opening in a circumferential length of the lower opening falls within a range of 24% to 48% (more preferably 30% to 42%). Preferably, in an attached state wherein both the chin cover and the neck cover are attached to the head protecting body, a proportion of an area of a portion of the second flexible cover member, which does not overlap the flexible cover member, in an area of a lower opening of an outer shell of the head protecting body falls within a range of 7% to 16% (more preferably 9% to 13%), and in the above attached state, a proportion of a circumferential length of a portion of the second flexible cover member, which does not overlap the flexible cover member, along a circumference of the lower opening in a circumferential length of the lower opening falls within a range of 6% to 30% (more preferably 10% to 20%). Preferably, in the attached state wherein both the chin cover and the neck cover are attached to the head protecting body, a proportion of an area of a portion of the flexible cover main body of the second flexible cover member, which does not overlap the flexible cover member, in an area of a lower opening of an outer shell of the head protecting body falls within a range of 6% to 16% (more preferably, 8% to 14%).

According to the first to third aspects of the present invention, in a region around the neck of the helmet wearer which is covered by the flexible cover member of the neck cover, a traveling wind and sound generated by it are reliably prevented from entering the head accommodating space of the helmet through the gap between the lower end of the head protecting body of the helmet and around the neck of the helmet wearer. Therefore, the sound which is generated by the traveling wind as the wind is caught in a ventilator, stabilizer, or the like can be effectively prevented from being heard as loud noise to the helmet wearer.

According to the third aspect of the present invention, the traveling wind which blows the chest of the helmet wearer and is directed toward the chin flows into the head protecting space from that region of the flexible cover member of the chin cover, which corresponds to the missing portion of the neck cover, toward the inner surface of the shield plate. Hence, the inner surface of the shield plate can be effectively prevented from being fogged. Also, an external voice and sound can be heard to a certain degree mainly through the region corresponding to the intermittent portion.

BEST MODE FOR CARRYING OUT THE INVENTION

A full-face-type helmet with a chin cover/neck cover according to an embodiment to which the present invention is applied will be described in "1. Structure of Full-Face-Type Helmet", "2. Structure of Chin Cover", "3. Structure of Neck Cover" and "4. How to Attach Chin Cover and Neck Cover to Helmet" with reference to the accompanying drawings.

1. Structure of full-face-Type Helmet

Figure 8:
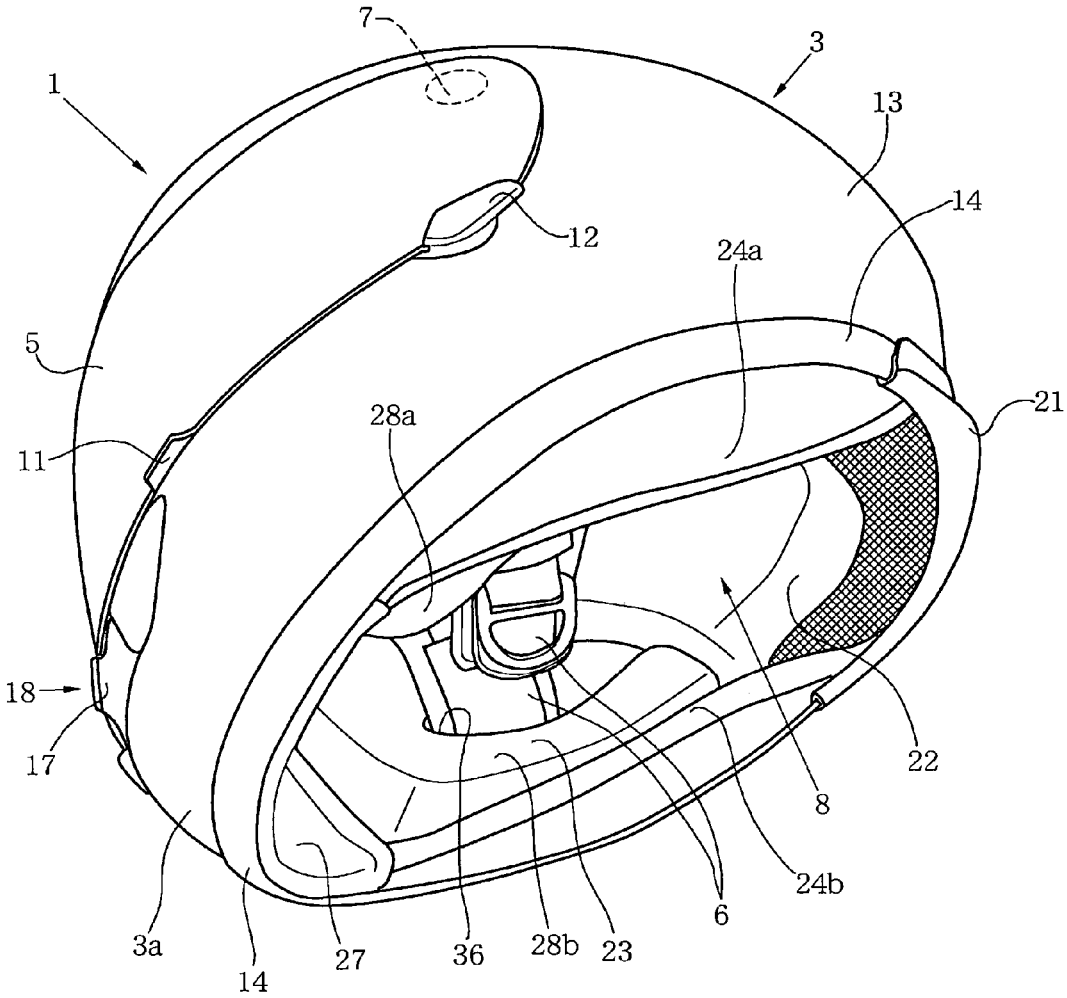
FIG. 8 is a perspective view, seen from obliquely behind and obliquely below, of the full-face-type helmet shown in FIG. 1.
Figure 9:
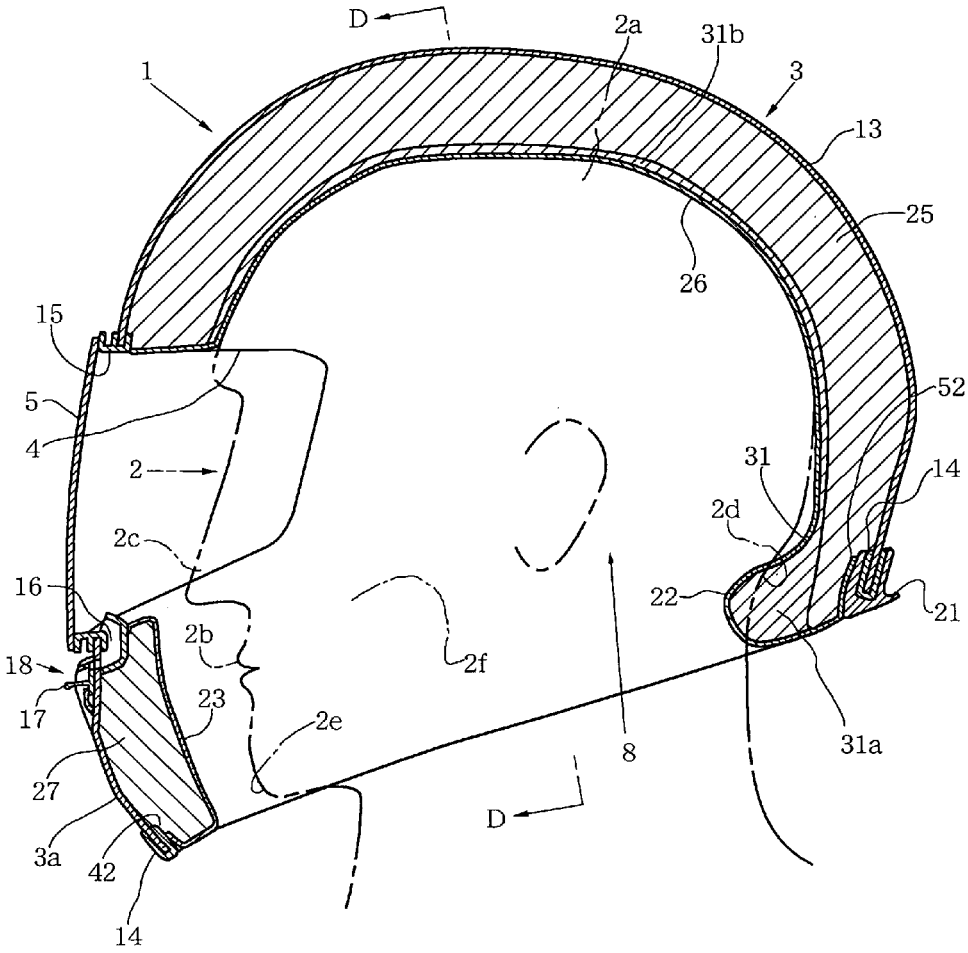
FIG. 9 is a sectional view, taken along the line C-C of FIG. 10, of the full-face-type helmet shown in FIG. 8.
Figure 10:
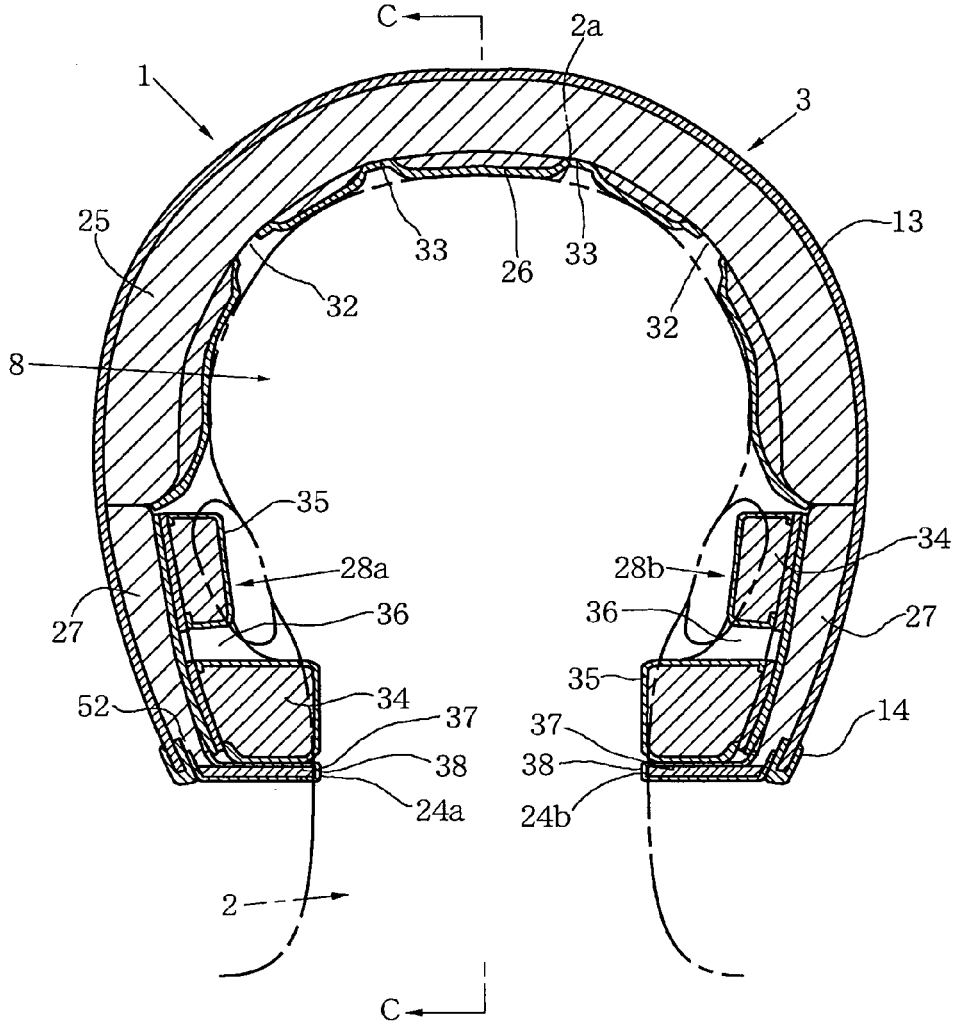
FIG. 10 is a sectional view, taken along the line D-D of FIG. 9, of the full-face-type helmet shown in FIG. 8.

A full-face-type helmet 1 is shown as a single member in FIGS. 8, 9 and 10. As shown in FIGS. 8 to 10, the full-face-type helmet 1 includes (a) a full-face-type head protecting cap body 3 to be worn on the head of a helmet wearer 2, (b) a shield plate 5 which can open/close a window opening 4 formed in the front surface of the head protecting body 3 to oppose a portion (i.e., the upper portion of the face) between a vertex 2*a* and mouth 2*b* of the helmet wearer 2, and (c) a pair of left and right chin straps 6 attached to the inside of the head protecting body 3.

As has been well known, the shield plate 5 can be made of a hard synthetic resin such as polycarbonate or another transparent or translucent hard material, and be attached to the head protecting body 3 with a pair of left and right attaching screws 7 to be pivotal forward and backward substantially in a vertical direction. The shield plate 5 closes the window opening 4 when located at the backward pivoting position shown in FIGS. 8 and 9, and opens the window opening 4 when located at the forward pivoting position which the shield plate 5 reaches by pivoting upward from the backward pivoting position. At the intermediate position between the two positions, the shield plate 5 can partly open the window opening 4. In FIG. 8, reference numeral 11 denotes a tab provided to the shield plate 5. The tab 11 is held by the helmet wearer 2 with his fingers when he is to pivot upward and downward the shield plate 5 forward and backward. Reference numeral 12 denotes an operating lever 12 provided to the head protecting body 3. The helmet wearer 2 holds the operating lever 12 with his fingers when he wishes to pivot upward the shield plate 5, which is located at the backward pivoting position, slightly forward.

As shown in FIGS. 8 to 10, the head protecting body 3 includes (d) a full-face-type outer shell 13 which forms the circumferential wall of the head protecting body 3, (e) a lower rim member 14 which has a substantially U-shaped section and is attached with an adhesive or the like to the outer shell 13 throughout substantially the entire lower end of the outer shell 13, (f) a window opening rim member 15 which has a substantially E-shaped section and is attached with an adhesive or the like to a window opening 19, formed in the outer shell 13 to form the window opening 4 of the head protecting body 3, throughout substantially the entire periphery of the window opening 19, (g) a ventilator 18 which has a vent hole 16 and a shutter member 17 that can open/close the vent hole 16 and is formed in that region in the vicinity of the nose lower end of the outer shell 13 which opposes the vicinity of the lower end of a nose 2*c* of the helmet wearer 2, (h) an air straightening stabilizer 21 which is attached with an adhesive or the like to the nape region of the outer shell 13 which opposes a rear portion (that is, nape) 2*d* of the neck of the helmet wearer 2 to cover the lower rim member 14, (i) a head backing member 22 which is attached inside the outer shell 13 with an adhesive or the like in contact with the inner surface of the outer shell 13 in a front head region, a vertex region, left and right side head regions and a back head region respectively corresponding to the front part, vertex, left and right parts and back part of the head of the helmet wearer 2, (j) a backing member 23 for the chin and cheeks, which is attached inside the outer shell 13 with an adhesive of the like in contact with the inner surface of the outer shell 13 in a chin region and cheek regions respectively opposing a chin 2*e* and cheeks 2*f* of the helmet wearer 2, and (k) a pair of left and right neck pads 24*a* and 24*b* which partly cover the lower surface of the backing member 22 for the head and the lower surface of the backing member 23 for the chin and cheeks, respectively.

Although not shown, a ventilator (e.g., a front head part and/or back head part ventilator provided to the outer shell 13 in the vicinity of the boundary between the front head region and/or back head region, and the vertex region) other than the ventilator 18 described in the above item (g) may be provided to the outer shell 13.

As has been well-known, the outer shell 13 can be made of a composite material formed by lining the inner surface of a strong shell body made of a hard synthetic resin, e.g., FRP, or another hard material with a flexible sheet such as porous unwoven fabric. As has been well-known, each of the lower rim member 14 and stabilizer 21 can be made of a soft synthetic resin, e.g., foamed vinyl chloride or synthetic rubber, or another soft material. As has been well-known, the window opening rim member 15 can be made of a highly flexible material such as synthetic rubber.

As shown in FIGS. 8 to 10, the backing member 22 for the head can include an impact-on-the-head absorbing liner 25 disposed in the outer shell 13, and a permeable backing cover 26 for the head which is attached to the inner surface of the impact-on-the-head absorbing liner 25 with an adhesive or the like so as to cover substantially the entire inner surface of the impact-on-the-head absorbing liner 25. The backing member 23 for the chin and cheeks can include an impact-on-the-chin-and-cheek absorbing liner 27 disposed in the outer shell 13, and a pair of left and right blockish inside pads 28*a* and 28*b* for the cheeks which are attached to the inner surface of the impact-on-the-chin-and-cheek absorbing liner 27 with an adhesive or the like in contact with the inner surface of the liner 27 in left and right cheek regions respectively opposing the let and right cheeks 2*f* of the helmet wearer 2.

As has been well-known, the impact-on-the-head absorbing liner 25 and impact-on-the-chin-and-cheek absorbing liner 27 shown in FIGS. 8 to 10 can be made of a synthetic resin such as a foamed synthetic resin (e.g., polystyrene foam) or another material with appropriate rigidity and appropriate plasticity. As has been well-known, the backing cover 26 for the head can be made of a combination of woven fabric or porous unwoven fabric formed by laminating layers 31, having appropriate shapes and made of an synthetic resin such as a foamed synthetic resin (e.g., urethane foam) or another flexible elastic material, on the surface (i.e., the outer surface) which opposes the impact-on-the-head absorbing liner 25, or two side surfaces. As shown in FIGS. 9 and 10, the layers 31 having the appropriate shapes can have a comparatively thick layer portion 31*a* in a region opposing the nape 2*d* of the helmet wearer 2, and a comparatively thin layer portion 31*b* in the remaining region. A plurality of elongated holes 32 can be formed in the backing cover 26 for the head to intermittently extend substantially in the back-and-forth direction. A plurality of thin elongated thermo-compression-bonded portions 33 can be formed in the thin layer portion 31*b* to extend substantially in the back-and-forth direction and left-to-right direction, respectively.

As has been well-known, the pair of left and right blockish inside pads 28*a* and 28*b* for the cheeks shown in FIGS. 8 to 10 can be formed of a pair of left and right thick plate-like cushion members 34 which are formed of a synthetic resin such as a foamed synthetic resin (e.g., urethane foam) or another flexible elastic material, and a pair of left and right bag-like members 35 which cover the pair of left and right cushion members 34 like bags. As has been well-known, the pair of left and right blockish inside pads 28*a* and 28*b* for the cheeks can include notches 36 (see FIG. 8) for the chin straps 6.

As has been well-known, the pair of left and right neck pads 24*a* and 24*b* shown in FIGS. 8 to 10 can be formed of a pair of left and right thin plate-like cushion members 37 which are made of a synthetic resin such as a foamed synthetic resin (e.g., urethane foam) or another flexible elastic material, and a pair of left and right flexible support members 38 which serve as flexible upper skin members that cover the pair of left and right flexible cushion members 37 substantially entirely like bags. As shown in FIG. 10, the pair of upper and lower outer ends of each of the pair of left and right support members 38 can be attached to the inner and outer surfaces of the impact-on-the-chin-and-cheek absorbing liner 27 with an adhesive or the like, respectively. The outer ends of the rear end portions of the pair of left and right neck pads 24*a* and 24*b* can be inserted between the outer shell 13 and impact-on-the-head absorbing liner 25, and sandwiched and held between them. As shown in FIG. 8, the pair of left and right neck pads 24*a* and 24*b* cover the left and right ends of the lower surface of the backing member 22 for the head and the left and right side portions of the lower surface of the backing member 23 for the chin and cheeks (more specifically, substantially the entire surfaces excluding the front ends of the lower surfaces of the pair of left and right blockish inside pads 28*a* and 28*b* for the chin and cheeks, and the left and right side portions excluding the central portion of the lower surface of the impact-on-the-chin-and-cheek absorbing liner 27) from below.

In the embodiment shown in FIGS. 8 to 10, the pair of left and right neck pads 24*a* and 24*b* shown in FIGS. 8 to 10 are attached to the impact-on-the-chin-and-cheek absorbing liner 27 with an adhesive or the like as described above and are not detachable. Alternatively, the pair of left and right neck pads 24*a* and 24*b* may be inserted between the outer shell 13 and impact-on-the-chin-and-cheek absorbing liner 27, and sandwiched and held between them so as to be detachable. In this case, substantially plate-like to-be-attached members (not shown) made of an elastic material can be respectively provided to the pair of left and right neck pads 24*a* and 24*b*. The outer ends of the neck pads 24*a* and 24*b* may be attached to the to-be-attached members with an adhesive or the like. Then, the to-be-attached members may be inserted between the outer shell 13 and the impact-on-the-head absorbing liner 25 (and impact-on-the-chin-and-cheek absorbing liner 27 when necessary) and detachably sandwiched and held between them. In this embodiment, as shown in FIG. 8, the pair of left and right neck pads are provided. Alternatively, a nape-side neck pad portion may be provided between the left and right neck pads 24*a* and 24*b*, and the nape-side neck pad portion and the left and right neck pads 24*a* and 24*b* may be linked sequentially to form a substantially U-shaped single neck pad as a whole.

2. Structure of Chin Cover

Figure 11:
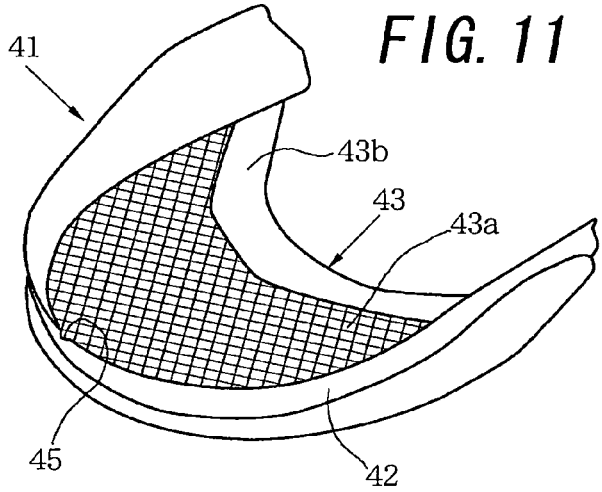
FIG. 11 is a perspective view, seen from obliquely ahead and obliquely above, of the chin cover shown in FIG. 1.
Figure 12:
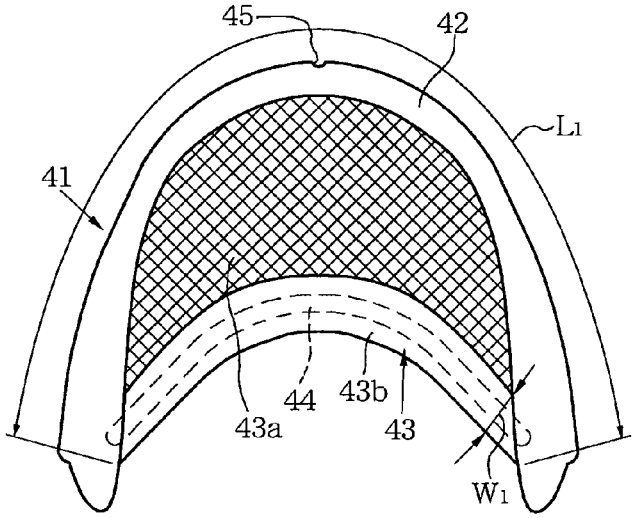
FIG. 12 is a plan view of the chin cover shown in FIG. 11.

A full-face-type helmet chin cover 41 which is to be attached to the full-face-type helmet 1 shown in FIGS. 8 to 10 as a single product is shown as a single product in FIGS. 11 and 12. As shown in FIGS. 11 and 12, the chin cover 41 has a substantially plate-like elastic to-be-attached member (i.e., a to-be-attached portion) 42, which serves as a shape holding member as well, is curved substantially arcuately substantially in the horizontal direction with its central portion projecting forward and rises in the substantially vertical direction, and a substantially crescent-shaped (a wide substantially crescent-like shape substantially close to a half moon) flexible cover member 43 which is attached to the elastic to-be-attached member 42 to enlarge backward substantially in the horizontal direction. The elastic to-be-attached member 42 can be monolithically molded of a synthetic resin such as soft polyethylene or another elastic material into a predetermined shape.

As shown in FIGS. 11 and 12, the flexible cover member 43 can include a substantially crescent-shaped (a wide crescent-like shape substantially close to a half moon) flexible cover main body 43*a* having flexibility and a flexible rim member 43*b* which is attached to the free end (i.e., a portion corresponding to the chord of the crescent-like shape) of the flexible cover main body 43*a* by sewing or the like to sandwich the free end. The flexible cover main body 43*a* can be attached to the elastic to-be-attached member 42 by sewing that portion (i.e., a portion opposing the portion corresponding to the chord) of the flexible cover main body 43*a*, which corresponds to the crescent-shaped arc, to near the lower end of the elastic to-be-attached member 42, or with an adhesive. That portion of the cover member 43 which corresponds to the chord of the crescent-shaped portion can be also configured a substantially arcuate portion which is curved toward its portion corresponding to the arc.

Figure 6:
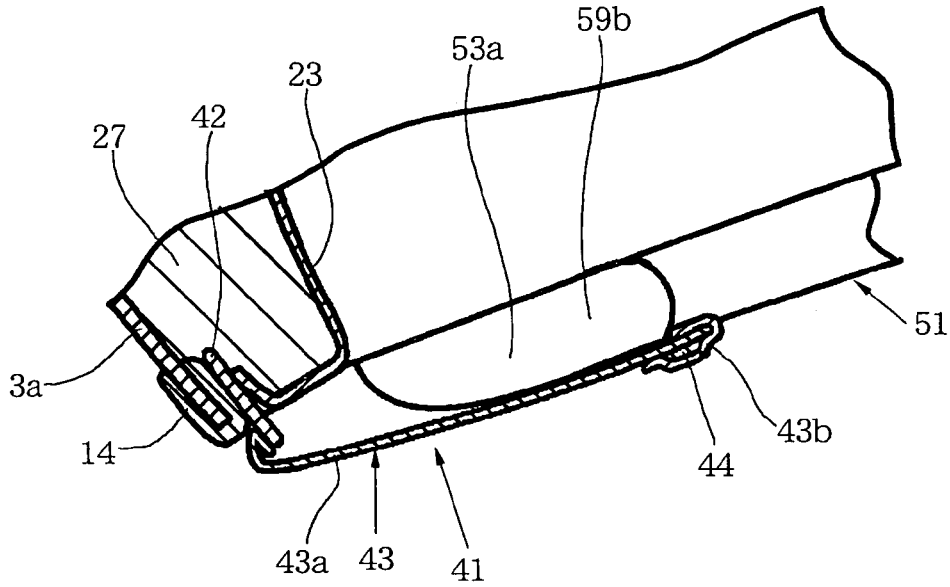
FIG. 6 is an enlarged longitudinal sectional view of the vicinity of the central portion of the full-face-type helmet with the chin cover/neck cover shown in FIG. 2 (the first embodiment)

The flexible cover main body 43*a* may be made of poreless, substantially non-permeable artificial leather, a poreless, substantially non-permeable sheet-type member such as a synthetic resin sheet, or a poor-permeable cloth material. As the flexible cover main body 43*a* preferably has a large number of pores and is permeable due to the following reason, it is preferably made of porous, permeable mesh cloth such as lace cloth (e.g., double raschel lace) obtained by lace-knitting lace yarn such as nylon yarn. As shown in FIGS. 6 and 12, the flexible rim member 43*b* can be formed of a stretchable, flexible tape-like member which is obtained by covering, with appropriate cloth such as piled fabric, a core member formed of, e.g., two rubber bands 44 that are separate apart. In this case, the tape-like member 43*b* can be used as it is bent into halves to sandwich the free end of the flexible cover main body 43*a* such that the two rubber bands 44 overlap.

Figure 4:
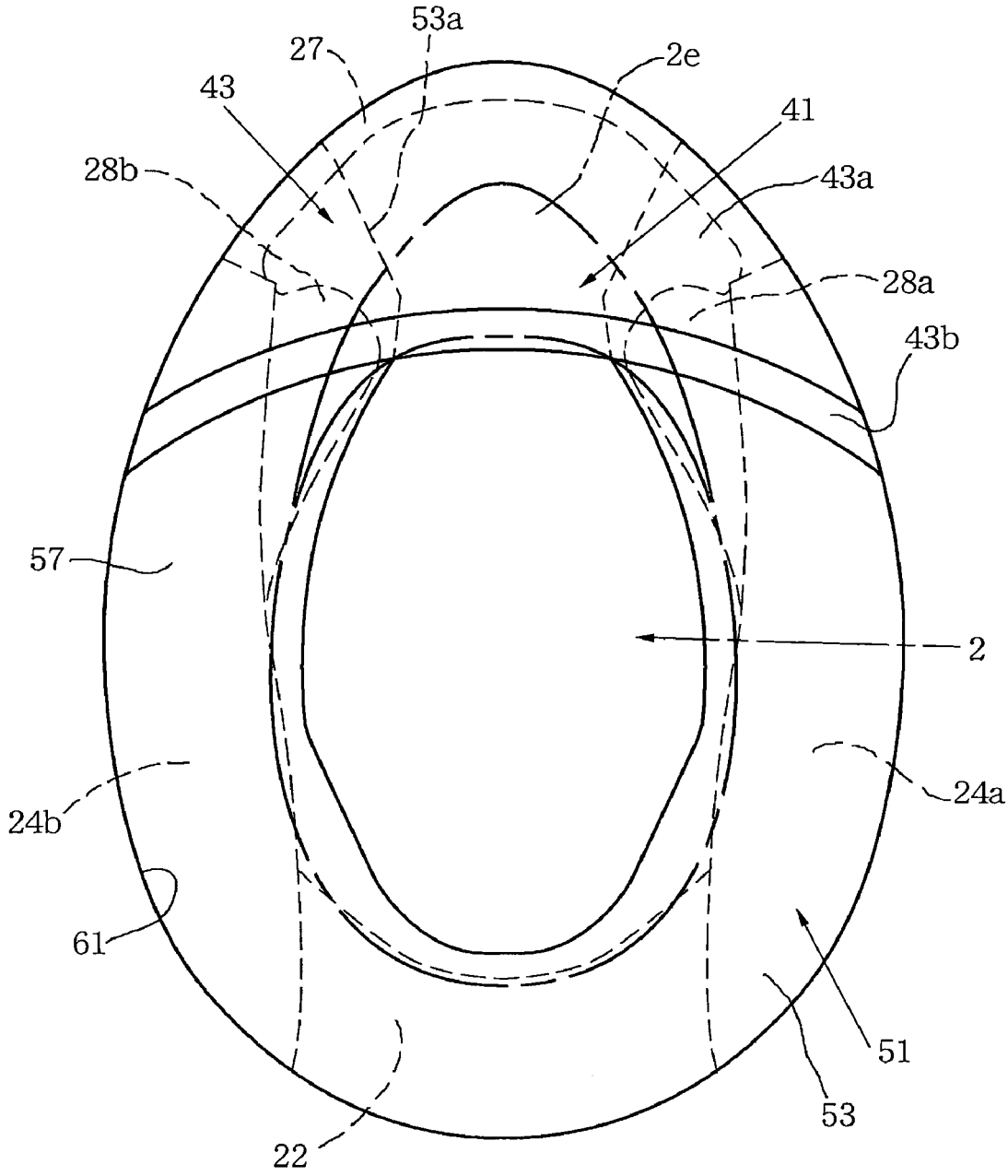
FIG. 4 is a bottom view of the full-face-type helmet with the chin cover/neck cover shown in FIG. 1.
Figure 5:
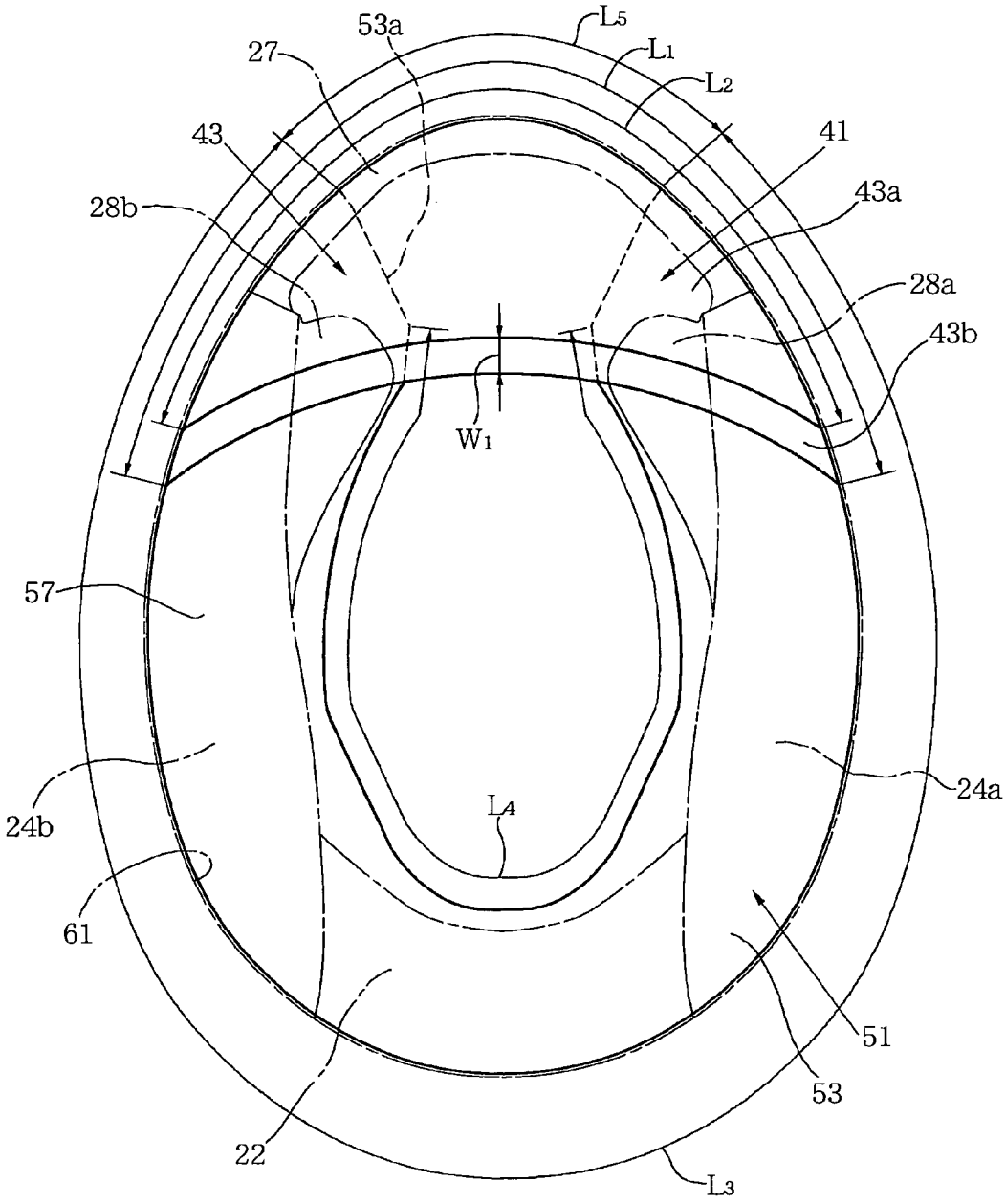
FIG. 5 is a bottom view, similar to FIG. 4, of the full-face-type helmet with the chin cover/neck cover shown in FIG. 4 in which the full-face-type helmet is indicated by an alternate long and short dashed line.

The elastic to-be-attached member 42 maintains substantially the same shape when it is monolithically molded and when it is attached to the full-face-type helmet 1 (see FIGS. 4 and 5). In a state wherein the elastic to-be-attached member 42 is assembled to form the chin cover 41 (i.e., a state wherein the flexible cover member 43 is already attached to the elastic to-be-attached member 42 but the elastic to-be-attached member 42 is not yet attached to the full-face-type helmet 1), as shown in FIGS. 11 and 12, the degree of bend of the elastic to-be-attached member 42 in substantially the horizontal direction is larger than in a state (see FIGS. 4 and 5) wherein the elastic to-be-attached member 42 is attached to the full-face-type helmet 1. This is due to the following reason. The flexible rim member 43*b* is stretched to a certain degree and attached to the flexible cover main body 42*a*. The contracting force of the flexible rim member 42*b* is applied to the elastic to-be-attached member 42 as a force that increases the degree of bend in substantially the horizontal direction. In the embodiment shown in FIGS. 11 and 12, a notch 45 is formed in the upper end of the central portion (i.e., the front end) in the left-to-right direction of the elastic to-be-attached member 42 to indicate the central position in the left-to-right direction of the elastic to-be-attached member 42. However, the notch 45 can be omitted.

3. Structure of Neck Cover

Figure 13:
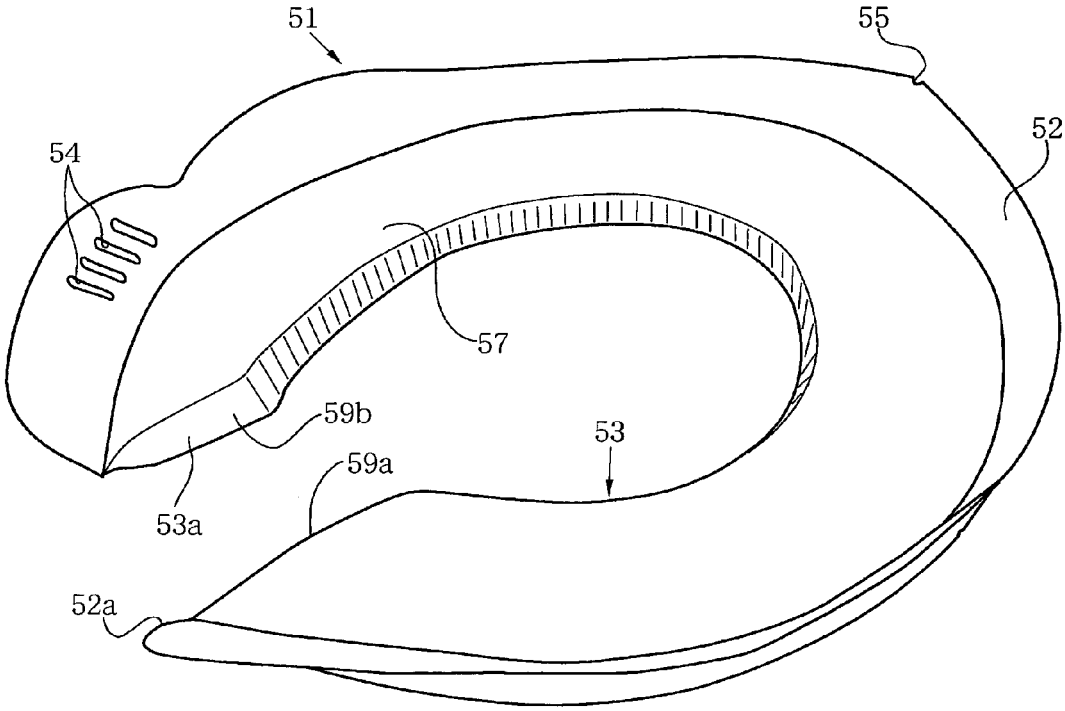
FIG. 13 is a perspective view, seen from obliquely ahead and obliquely above, of the neck cover shown in FIG. 1.
Figure 14:
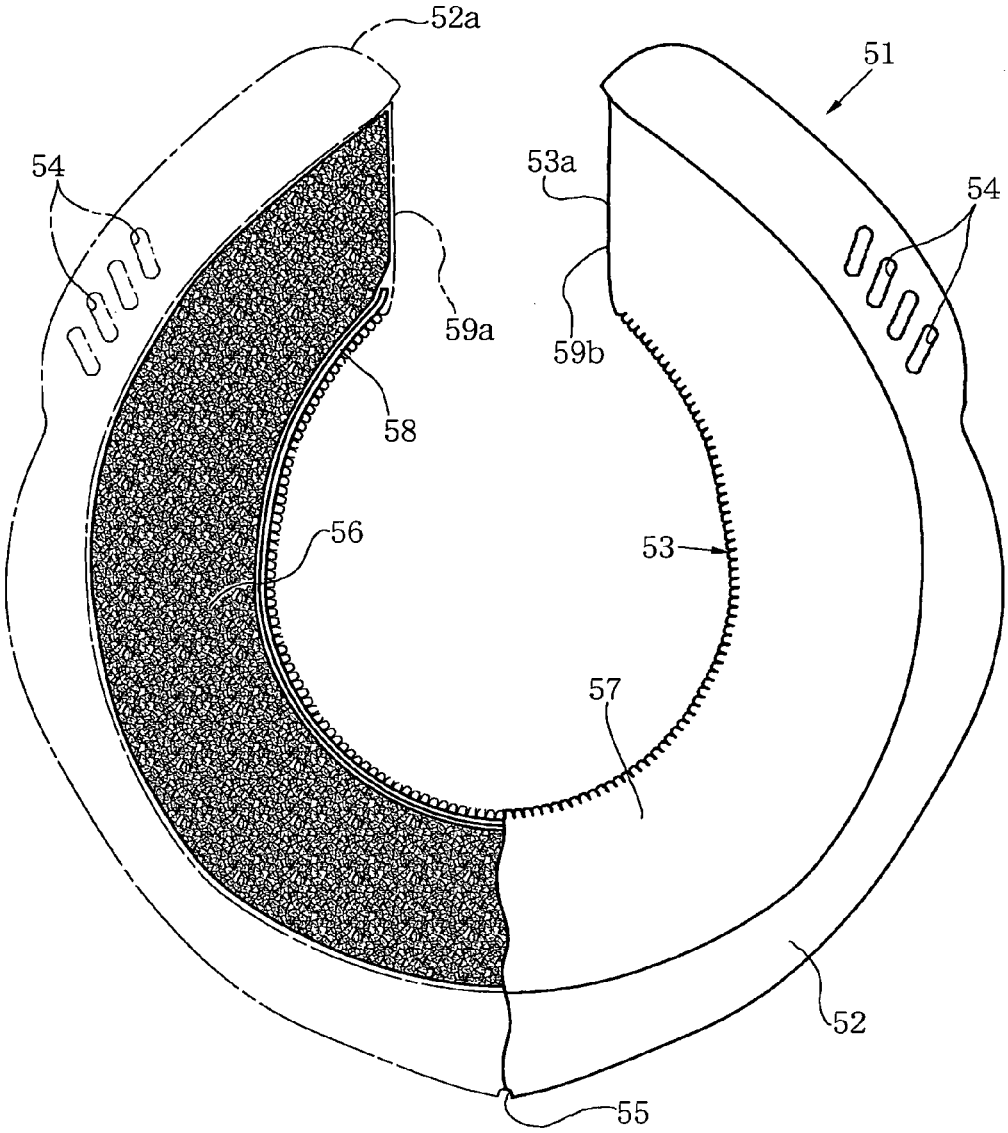
FIG. 14 is a plan view of the neck cover shown in FIG. 13 in which the flexible support member and elastic to-be-attached member on the left half are respectively indicated by alternate long and short dashed lines.

A full-face-type helmet neck cover 51 which is to be attached to the full-face-type helmet 1 shown as a single product in FIGS. 8 to 10 is shown as a single product in FIGS. 13 and 14. As shown in FIGS. 13 and 14, the neck cover 51 has a substantially plate-like elastic to-be-attached member (i.e., a to-be-attached portion) 52 which serves as a shape holding member as well, and a flexible band-like cover member 53. The elastic to-be-attached member 52 extends in its lengthwise direction to be curved substantially in an egg-like shape (a planar substantial egg-like shape) substantially in the horizontal direction with its central portion projecting backward, and extends in the widthwise direction outwardly to be inclined obliquely upward. The outer peripheral portion of the flexible cover member 53 is attached to the lower end of the elastic to-be-attached member 52 so as to extend along the elastic to-be-attached member 52 on the lower end side of the elastic to-be-attached member 52. The flexible cover member 53 is held in a substantially predetermined shape (that is, shaped-held) by the to-be-attached member 52 serving also as the shape holding member.

As shown in FIGS. 13 and 14, the elastic to-be-attached member 52 and flexible cover member 53 are respectively intermittent at substantially the central portions of their front portions to form substantially annular shapes having intermittent portions (i.e., gap portions) 52*a* and 53*a* as missing portions. Each annular shape has substantially an egg-like shape (planar substantial egg-like shape) with its front end side sharper than its rear side. The left and right ends of the elastic to-be-attached member 52 and the left and right ends of the flexible cover member 53 are present on the left and right sides of the intermittent portions 52*a* and 53*a*, respectively. The elastic to-be-attached member 52 can be monolithically molded of a synthetic resin such as soft polyethylene or another elastic material into a predetermined shape. A plurality of elongated holes 54 as through holes can be formed near the pair of left and right front ends of the elastic to-be-attached member 52 so as to extend substantially parallel to each other inclinedly. The elongated holes 54 improve the design, and when the elastic to-be-attached member 52 is attached to the head protecting body 3, the elongated holes 54 make firm the bonding of the elastic to-be-attached member 52 and the head protecting body 3. In the embodiment shown in FIGS. 13 and 14, a notch 55 is formed in the upper end of the central portion (i.e., the rear end) in the left-to-right direction of the elastic to-be-attached member 52 to indicate the central position in the left-to-right direction of the elastic to-be-attached member 52. However, the notch 55 can be omitted.

As shown in FIG. 14, the flexible cover member 53 preferably includes a substantially plate-like flexible cushion member 56 which is made of only a foamed synthetic resin such as soft urethane foam or soft foamed polyethylene, and a flexible support member 57 which serves as a flexible surface skin member that covers the flexible cushion member 56 substantially entirely like a bag to support it. When the flexible cushion member 56 is accommodated in the flexible support member 57, the flexible support member 57 has substantially the same planar shape and the same thickness as those of the flexible cover member 53. The planar shape and thickness of the cushion member 56 are slightly smaller than those of the flexible cover member 53 respectively by a value substantially corresponding to the sum of the size of the support member 57 and a very small gap between the cushion member 56 and support member 57 and, a value substantially corresponding to the sum of the thickness of the support member 57 and a very small gap between the cushion member 56 and support member 57. As shown in FIG. 14, a rubber band 58 is attached to substantially the entire inner circumferential surface of the flexible cover member 53 by sewing or the like to be substantially vertical.

Figure 7:
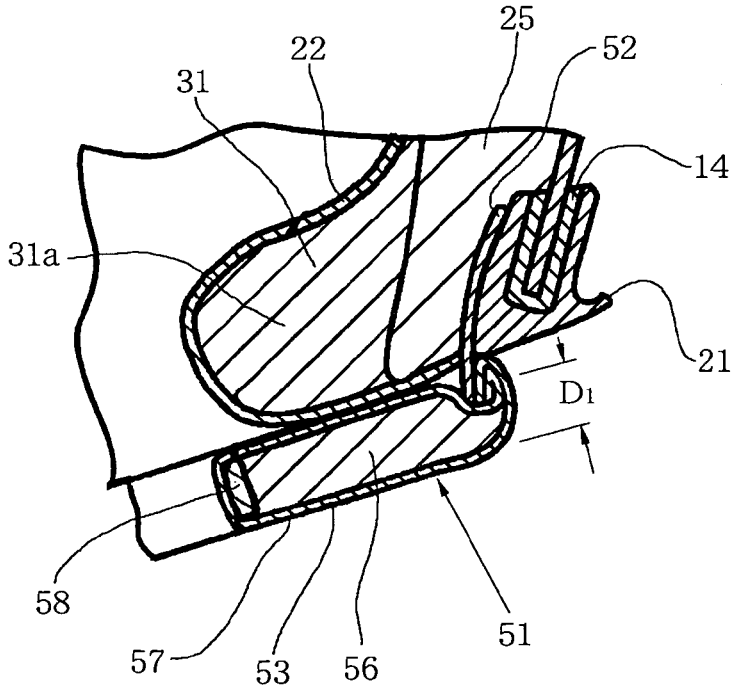
FIG. 7 is an enlarged longitudinal sectional view of the vicinity of the central portion of the full-face-type helmet with the chin cover/neck cover shown in FIG. 2.
Figure 17:
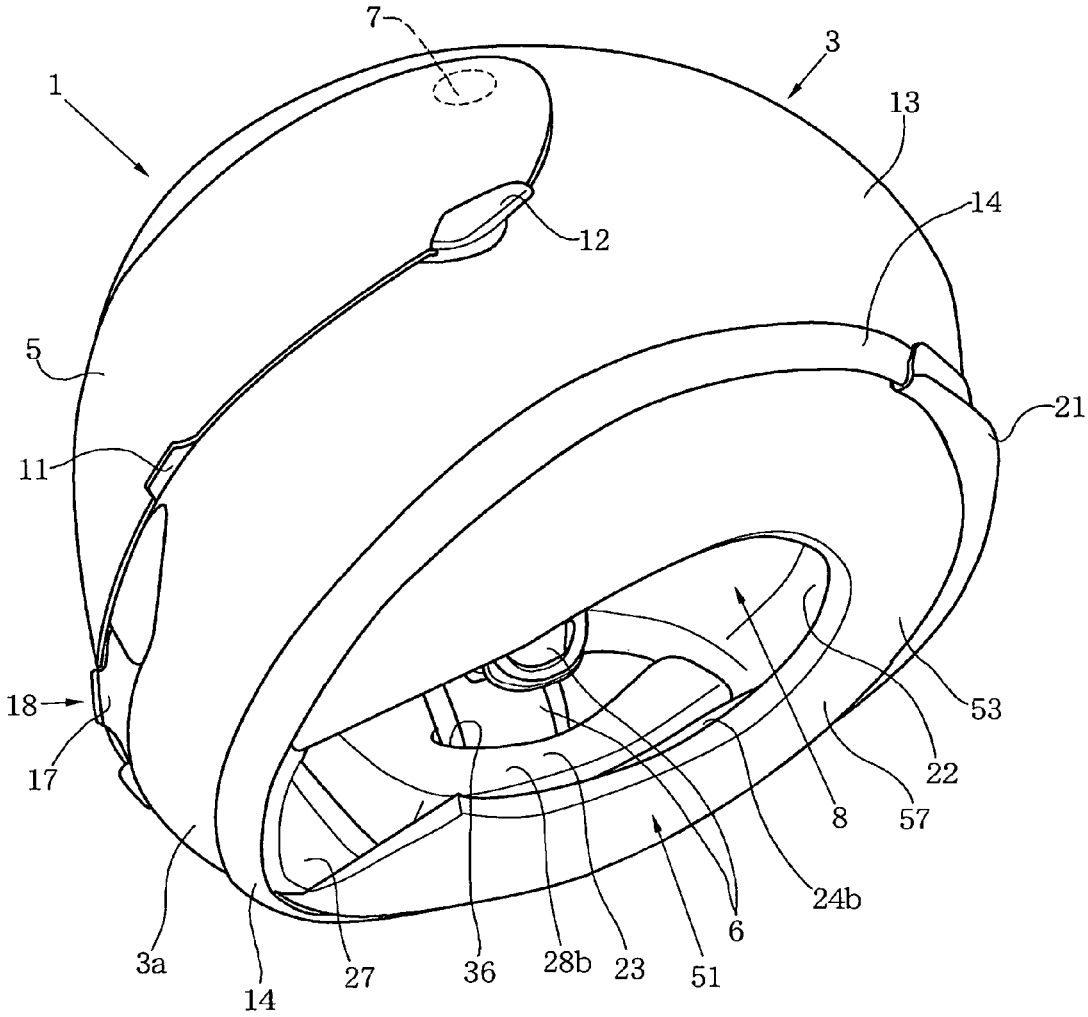
FIG. 17 is a perspective view, seen from obliquely behind and obliquely below, of a full-face-type helmet with a neck cover which is formed by attaching only the neck cover shown in FIG. 13 to the full-face-type helmet shown in FIG. 8.
Figure 18:
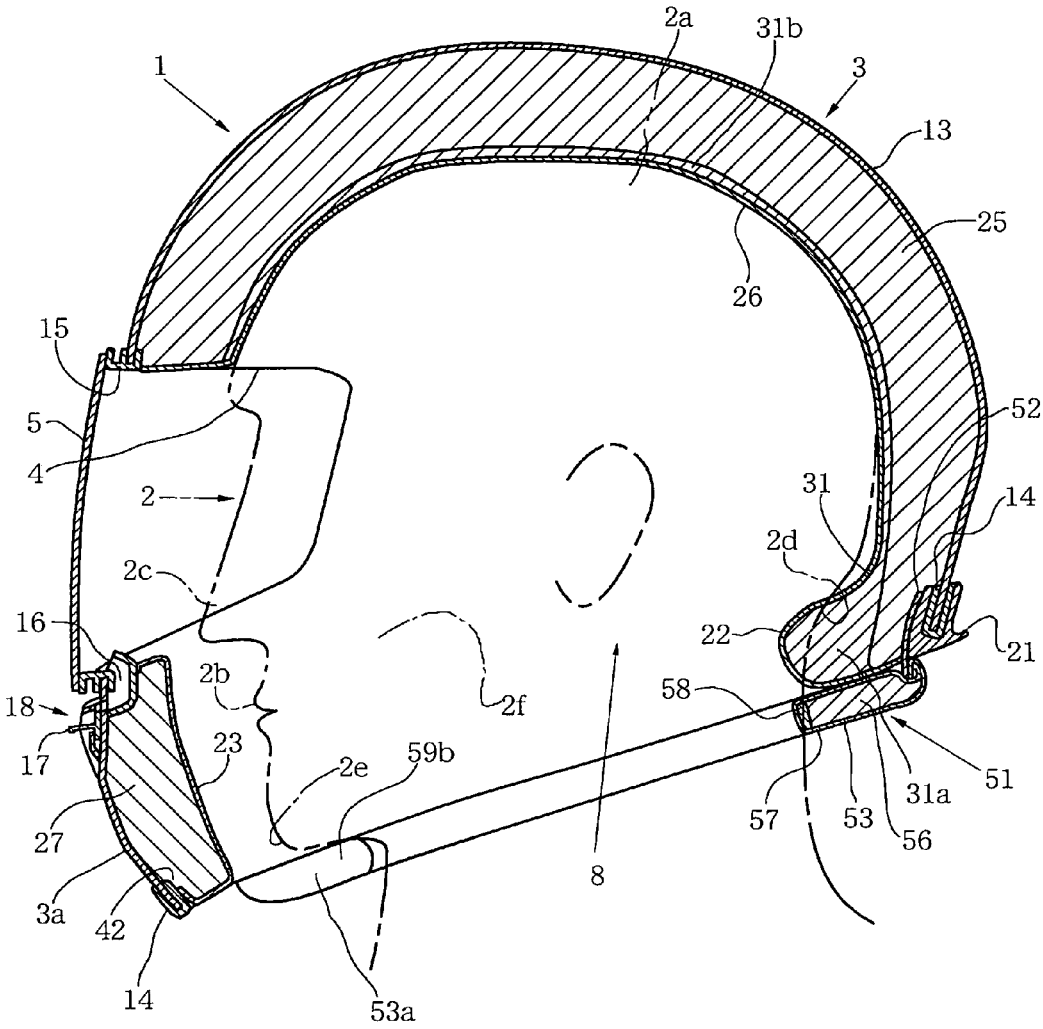
FIG. 18 is a longitudinal sectional view, similar to FIG. 2, of the full-face-type helmet with the neck cover shown in FIG. 17.

The elastic to-be-attached member 52 maintains substantially the same shape when it is monolithically molded and when it is attached to the full-face-type helmet 1 (see FIGS. 17 and 18). In a state wherein the elastic to-be-attached member 52 is assembled to form the neck cover 51 (i.e., a state wherein the flexible cover member 53 is already attached to the elastic to-be-attached member 52 but the elastic to-be-attached member 52 is not yet attached to the full-face-type helmet 1), as shown in FIGS. 13 and 14, the degree of bend of the elastic to-be-attached member 52 in substantially the horizontal direction is larger than in a state see FIGS. 17 and 18 wherein the elastic to-be-attached member 52 is attached to the full-face-type helmet 1, and the upper end of the elastic to-be-attached member 52 is inclined outwardly rather than it is upright in substantially the vertical direction. One of the reasons for this is as follows. The rubber band 58 is stretched to a certain degree and attached to the support member 57. The contracting force of the rubber band 58 is applied to the elastic to-be-attached member 52 as a force that increases the bend in substantially the horizontal direction. Another reason for this is as follows. As shown in FIG. 7, the elastic to-be-attached member 52 is attached to a bent portion which is formed by bending the outer peripheral end of the support member 57. The restoration force of the bent portion acts on the elastic to-be-attached member 52.

The cushion member 56 need not be made of only a foamed synthetic resin but suffices as far as it is a flexible foamed synthetic resin sheet (i.e., a substantially plate-like foamed synthetic resin) which is mainly made of urethane foam, foamed polyethylene, or the like. A surface skin layer may be formed on one or two surfaces of the foamed synthetic resin sheet. As the surface skin layer, a glass-wool sheet formed of glass-wool layers, a polypropylene film, a polyester film, another synthetic resin film, unwoven fabric, or the like can be used. The surface skin layer may only be formed on one or two surfaces of the foamed synthetic resin sheet by stacking, or with an adhesive. The surface skin layer may be formed on one or two surfaces of the foamed synthetic resin sheet by coating a synthetic resin such as polypropylene or polyester. The cushion member 56 may be a laminated body of a foamed synthetic resin which is formed by stacking a high-density foamed synthetic resin sheet (e.g., a high-density urethane foam sheet) and a low-density foamed synthetic resin sheet (e.g., a low-density urethane foam sheet), or the like.

A depth $D_1$ (see FIG. 7) of the cushion member 56 as a single product is about 9 mm in the embodiment shown in FIG. 7. According to the present invention, generally, an average thickness $D_1$ of the flexible cushion member 56 as a single product falls preferably within a range of 4 mm to 18 mm from the viewpoint of practicality and further preferably within a range of 6 mm to 12 mm. The support member 57 is formed of a poreless, non-permeable, flexible artificial leather sheet in the embodiment shown in FIG. 7. Alternatively, as the poreless, substantially non-permeable, flexible sheet-type material, another sheet material such as a one made of synthetic resin (e.g., synthetic rubber, polypropylene, or polyester) may be used. The support member 57 may be formed by sewing a plurality of sheet-type materials together, bonding them with an adhesive or the like to form a bag as shown in FIGS. 13 and 14.

The permeability of the foamed synthetic resin that forms the cushion member 56 of the flexible cover member 53 of the neck cover 51 is particularly devised to increase the sound-absorbing properties of the flexible cover member 53. To explain this, two practical examples of the flexible cover member 53 in the embodiment shown in FIG. 7 will be described.

PRACTICAL EXAMPLE 1

A cushion member 56 formed of only a soft urethane foam sheet having a thickness $D_1$ (see FIG. 7) of about 9 mm was covered substantially entirely by a flexible support member 57 formed of an artificial leather sheet substantially like a bag to fabricate a flexible cover member 53. When the urethane foam sheet was measured by using the Frajour type method based on JIS L 1096, its permeability K was 4.5 cc/cm$^2$·sec and its density was 40 kg/cm$^3$.

PRACTICAL EXAMPLE 2

A flexible support member 57 made of thick permeable cloth was adhered with an adhesive to one surface of a cushion member 56 formed of only a soft urethane foam sheet having a thickness $D_1$ (see FIG. 7) of about 9 mm to fabricate a flexible cover member 53. The shape of the thick cloth was substantially the same as or more or less larger than that of one surface of the cushion member 56. When the urethane foam sheet was measured by using the Frajour type method based on JIS L 1096, its permeability K was 1.5 cc/cm$^2$·sec and its density was 50 kg/cm$^3$.

Soft urethane foam which is usually used as the cushion member of this type is basically made of open cell bodies. In contrast to this, the soft urethane foam used in the practical examples 1 and 2 is a material the permeability of which is very small and the flexibility of which is not particularly low. This soft urethane foam is obtained with an original composition and foaming technique so that the cell membranes are left as much as possible to decrease open cells and increase closed cells. In this case, the cells (particularly open cells) are few in the vicinity of one or two surfaces of the soft urethane foam sheet, and comparatively many cells can be formed between the two surfaces (i.e., in the central portion).

According to the present invention, the permeability K of the foamed synthetic resin as the main constituent material of the cushion member 56, which is measured by using the Frajour type method based on JIS L 1096, falls generally within a range of 0.1 to 10 cc/cm$^2$·sec, preferably within a range of 0.2 to 5 cc/cm$^2$·sec and more preferably within a range of 0.3 to 2 cc/cm$^2$·sec from the viewpoint of practice. The density of the foamed synthetic resin falls generally preferably within a range of 20 to 80 kg/m$^3$, more preferably within a range of 25 to 70 kg/m$^3$ and most preferably within a range of 30 to 60 kg/m$^3$ from the viewpoint of practice. In this case, the range of the density of 20 to 80 kg/m$^3$ substantially corresponds to the range of the permeability K of 0.1 to 10 cc/cm$^2$·sec. The range of the density of 25 to 70 kg/m$^3$ substantially corresponds to the range of the permeability K of 0.2 to 5 cc/cm$^2$·sec. The range of the density of 30 to 60 kg/m$^3$ substantially corresponds to the range of the permeability K of 0.3 to 2 cc/cm$^2$·sec. When the permeability K is 2 (exclusive) to 10 cc/cm$^2$, sec, generally, the cushion member 56 is particularly desirably covered like a bag substantially entirely by a non-permeable flexible sheet material. If the permeability K is 0.1 to 2 (inclusive) cc/cm$^2$, sec, generally, the necessity that the cushion member 56 should be covered like a bag substantially entirely by a non-permeable flexible sheet member, in the same manner as in practical example 1, is not so high. The cushion member 56 may be covered like a bag substantially entirely by a permeable flexible sheet material (e.g., permeable cloth). In this case, a comparatively large opening is formed in one or two surfaces of the flexible sheet material, and the cushion member 56 need not be covered like a bag. Alternatively, only a sheet-type member may be adhered to one surface of the cushion member 56, in the same manner as in practical example 2.

The cushion member 56 is made of urethane foam in the embodiment shown in the drawings. If the permeability K measured by using the Frajour type method based on JIS L 1096 falls within the predetermined numerical range as described above, the cushion member 56 may be made of another flexible foamed synthetic resin such as foamed polyethylene.

4. How to Attach Chin Cover and Neck Cover to Helmet

The procedure of attaching the chin cover 41 shown in FIGS. 11 and 12 and the neck cover 51 shown in FIGS. 13 and 14 to the head protecting body 3 of the full-face-type helmet 1 shown in FIGS. 8 to 10 will be described in "(i) How to Attach Chin Cover to Helmet", "(ii) How to Attach Neck Cover to Helmet" and "(iii) How to Attach Both Chin Cover and Neck Cover to Helmet" with reference to the accompanying drawings.

(i) How to Attach Chin Cover to Helmet

Figure 15:
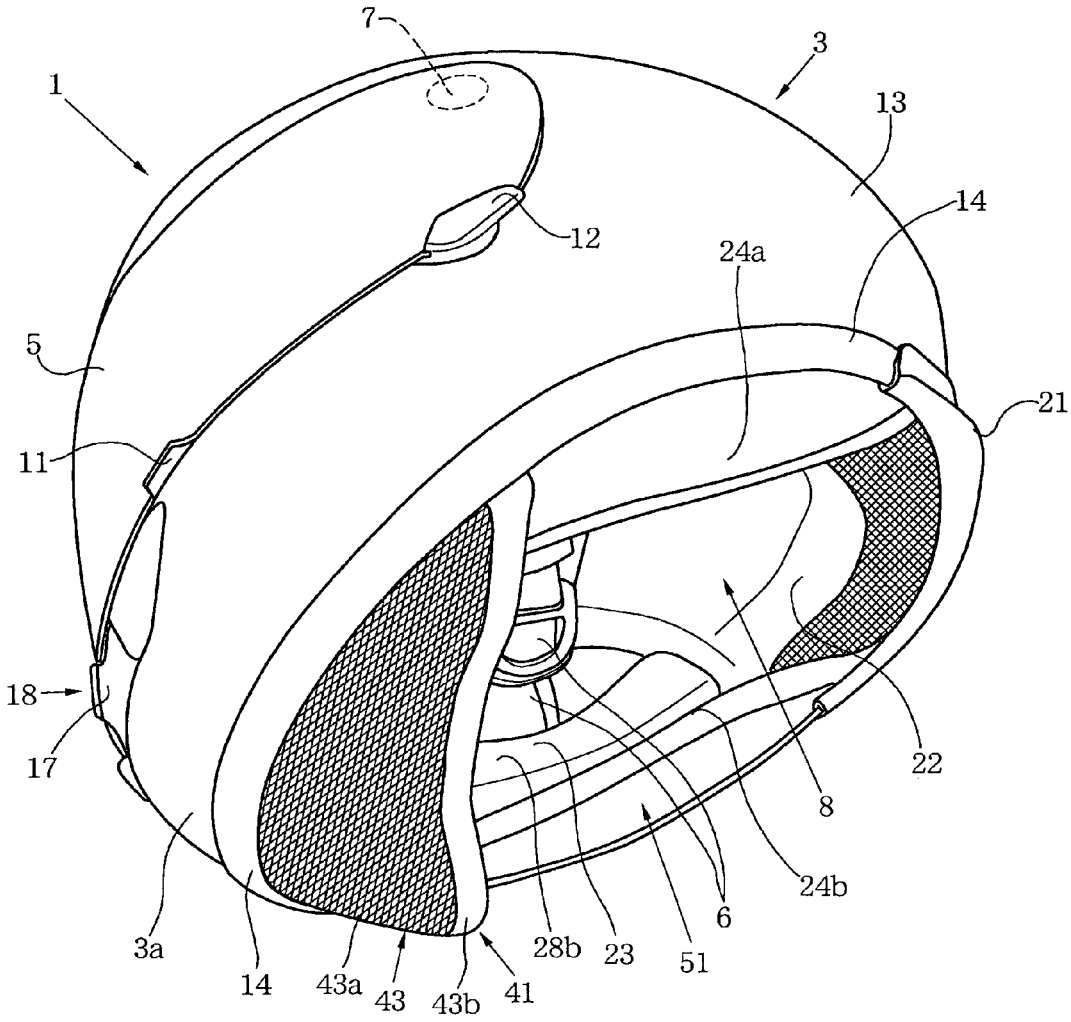
FIG. 15 is a perspective view, seen from obliquely behind and obliquely below, of a full-face-type helmet with a chin cover which is formed by attaching only the chin cover shown in FIG. 11 to the full-face-type helmet shown in FIG. 8.

When attaching the chin cover 41 shown in FIGS. 11 to 12 to the full-face-type helmet 1 shown in FIGS. 8 to 10, first, the elastic to-be-attached member 42 of the chin cover 41 is widened in substantially the horizontal direction, and the degree of its bend in substantially the horizontal direction is decreased to the state shown in FIGS. 4, 5 and 15.

Figure 16:
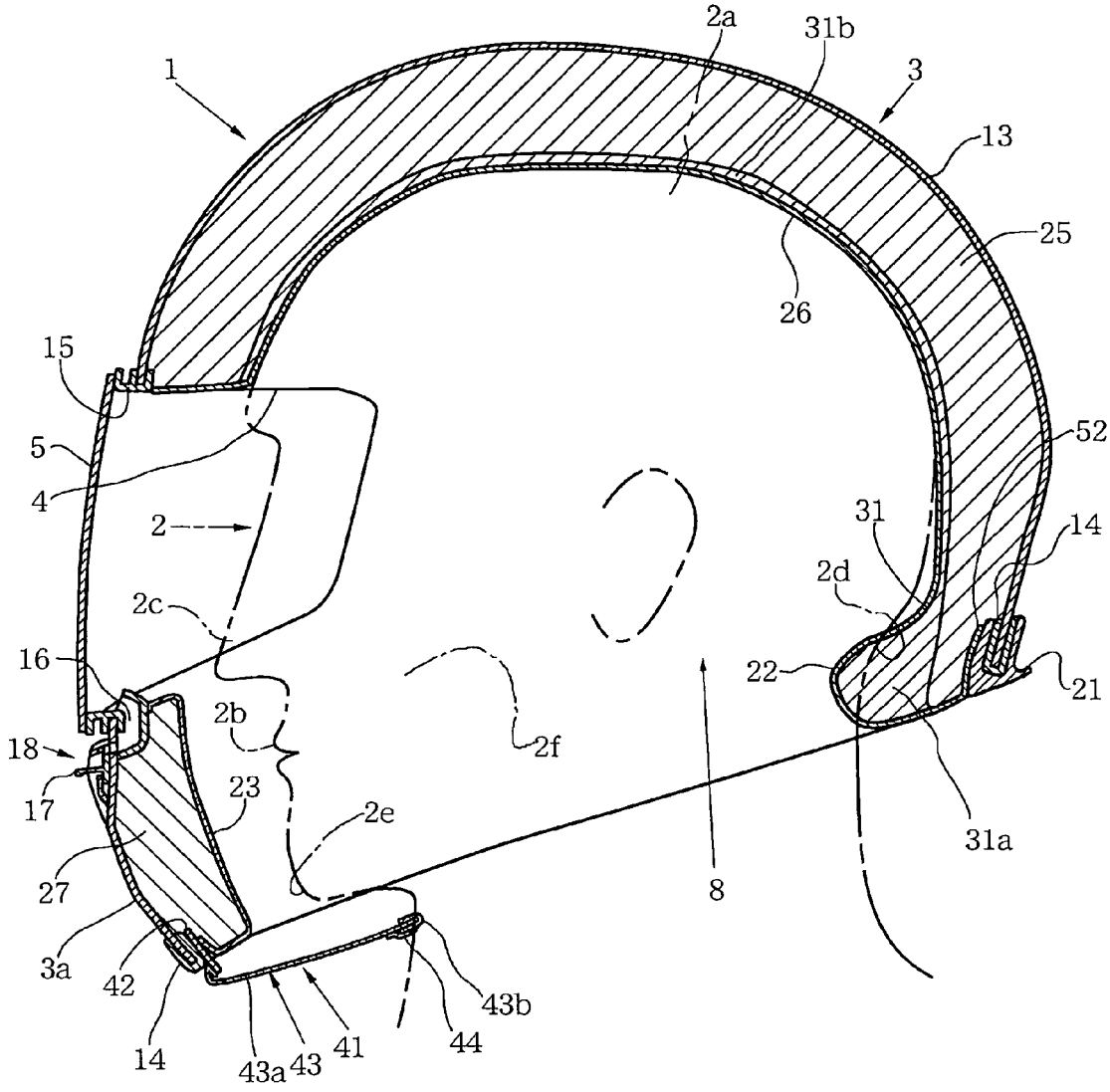
FIG. 16 is a longitudinal sectional view, similar to FIG. 2, of the full-face-type helmet with the chin cover shown in FIG. 15.

Subsequently, as shown in FIGS. 15 and 16, the elastic to-be-attached member 42 is inserted between the outer shell 13 and impact-on-the-chin-and-cheek absorbing liner 27 (more specifically, between the inner peripheral surface of the lower rim member 14 and the outer peripheral surface of the impact-on-the-chin-and-cheek absorbing liner 27) starting with its upper end substantially upward from substantially below. This insertion can be performed until the proximal end of the flexible cover main body 43*a* of the flexible cover member 43 abuts against the lower end of the lower rim member 14 and is position-regulated, as shown in FIG. 6. In this state, the elastic to-be-attached member 42 is contact-bonded between the inner peripheral surface of the lower rim member 14 and the outer peripheral surface of the impact-on-the-chin-and-cheek absorbing liner 41. For this purpose, the elastic to-be-attached member 42 and accordingly the chin cover 41 are attached to the head protecting body 3 so as not to drop easily. When removing the chin cover 41 from the head protecting body 3, the proximal end or the like of the flexible cover member 43 may be held with the hand and strongly pulled downward. In this case, the elastic to-be-attached member 42 is extracted substantially downward through between the inner surface of the lower rim member 14 and the outer surface of the impact-on-the-chin-and-cheek absorbing liner 27.

In the state shown in FIGS. 15 and 16 as well wherein only the chin cover 41 is attached to the head protecting body 3 of the full-face-type helmet 1, the helmet wearer 2 can put the full-face-type helmet with the chin cover on his head and ride the motorbike. In other words, in the state shown in FIGS. 15 and 16 as well, the full-face-type helmet 1 can be used as a full-face-type helmet with a chin cover. In this case, the flexible cover member 43 covers the chin 2*e* of the helmet wearer 2 from below.

The relationship between the lower end face of the full-face-type helmet 1 of the full-face-type helmet with the chin cover shown in FIGS. 15 and 16 and the chin cover 41 shown in FIGS. 11 and 12 will be described with reference to FIG. 5. More specifically, in FIG. 5 (in other words, the embodiment shown in FIG. 5), the area of a lower opening 61 (more specifically, the region surrounded by the inner surface of the lower rim member 14; this applies to the following description) of the outer shell 13 of the full-face-type helmet with the chin cover is about 39,000 $mm^2$ The circumferential length (i.e., the sum of a circumferential length L3 (to be described later) and a circumferential length L5 (to be described later)) of the lower opening 61 of the outer shell 13 is about 720 mm. In contrast to this, the proportion of the area of the chin cover 41 (more specifically, the flexible cover member 43) in the area of the lower opening 61 is about 23% (i.e., about 9,000 $mm^2$). An average width W1 (see FIG. 5) of the flexible rim member 43*b* of the flexible cover member 43 is about 10 mm. The proportion of a circumferential length L1 (see FIG. 5) of the flexible cover member 43 along the circumference of the lower opening 61 in the circumferential length (L3+L5) of the lower opening 61 of the outer shell 13 is about 40% (i.e., about 290 mm). The proportion of the area of the flexible cover main body 43*a* in the area of the lower opening 61 is about 18% (i.e., about 7,000 $mm^2$). A circumferential length L2 of the flexible cover main body 43*a* along the circumference of the lower opening 61 in the circumferential length (L3+L5) of the lower opening 61 of the outer shell 13 is about 36% (i.e., about 260 mm).

From the viewpoint of practicality, the various values described above in FIG. 5 generally preferably fall within the numerical ranges described in the following items (1) to (11) according to the present invention. In the items (1) to (11), the numerical ranges in parentheses are further preferable numerical ranges.

(1) The area of the lower opening 61: 28,000 $mm^2$ to 52,000 $mm^2$ (32,000 $mm^2$ to 48,000 $mm^2$)

(2) The circumferential length (L3+L5) of the lower opening 61: 600 mm to 840 mm (640 mm to 800 mm)

(3) The proportion of the area of the flexible cover member 43 in the area of the lower opening 61: 14% to 34% (18% to 28%)

(4) The area of the flexible cover member 43: 5,600 mm to 13,000 mm (7,200 mm to 11,000 mm)

(5) The average width W1 of the flexible rim member 43*b*: 5 mm to 20 mm (7.5 mm to 15 mm)

(6) The proportion of the circumferential length L1 of the flexible cover member 43 along the circumference of the lower opening 61 in the circumferential length (L3+L5) of the lower opening 61: 28% to 52% (34% to 46%)

(7) The circumferential length L1 of the flexible cover member 43 along the circumference of the lower opening 61: 200 mm to 380 mm (240 mm to 340 mm)

(8) The proportion of the area of the flexible cover main body 43*a* in the area of the lower opening 61: 8% to 26% (12% to 22%)

(9) The area of the flexible cover main body 43*a*: 4,400 $mm^2$ to 10,200 $mm^2$ (5,600 $mm^2$ to 8,600 $mm^2$)

(10) The proportion of the circumferential length L2 of the flexible cover main body 43*a* along the circumference of the lower opening 61 in the circumferential length (L3+L5) of the lower opening 61: 24% to 48% (30% to 42%)

(11) The circumferential length L2 of the flexible cover main body 43*a* along the circumference of the lower opening 61: 180 mm to 340 mm (220 mm to 300 mm)

When the helmet wearer 2 puts the full-face-type helmet with the chin cover shown in FIGS. 15 and 16 on his head and rides the motorbike, the traveling wind which blows the chest of the helmet wearer 2 and is directed toward the chin 2*e* is interrupted by the flexible cover member 43 of the chin cover 41 to a certain degree. Hence, the traveling wind is prevented to a certain degree from entering the head accommodating space 8 of the full-face-type helmet with the chin cover helmet through the gap between the lower end of the chin cover 3*a* of head protecting body 3 and the chin 2*e* of the helmet wearer 2. Also, a sound which is generated by the traveling wind as it is caught in the ventilator 18, another ventilator (e.g., a front head and/or back head ventilator which is formed in the outer shell 13 in the vicinity of the boundary between the front head region and/or back head region, and the vertex region), the stabilizer 21, or the like of the helmet is interrupted more or less by the flexible cover member 43 of the chin cover 41. Therefore, the sound generated by the traveling wind is prevented more or less from entering the head accommodating space 8 of the helmet through the gap between the lower end of the chin cover 3*a* of the head protecting body 3 and the chin 2*e* of the helmet wearer 2.

The flexible cover main body 43*a* of the flexible cover member 43 is preferably made of a poreless, substantially non-permeable or poor-permeable sheet-type material such as an artificial leather sheet cloth material, or the like when considering only the effect of preventing the traveling wind and the sound generated by it from entering the head accommodating space 8 of the full-face-type helmet with the chin cover through the gap between the lower end of the chin cover 3*a* of the head protecting body 3 and the chin 2*e* of the helmet wearer 2. When considering both the effect of preventing entering of the traveling wind and the sound generated by it, and the effect of anti-fogging the shield plate 5, the flexible cover main body 43*a* of the flexible cover member 43 is preferably made of porous, highly permeable mesh cloth.

(ii) How to Attach Neck Cover to Helmet

When attaching the neck cover 51 shown in FIGS. 13 and 14 to the full-face-type helmet 1 shown in FIGS. 8 to 10, the elastic to-be-attached member 52 of the neck cover 51 is enlarged in substantially the horizontal direction, and the degree of its bend in substantially the horizontal direction is decreased to the state shown in FIGS. 4, 5 and 17. Simultaneously, as shown in FIGS. 17 and 18, the elastic to-be-attached member 52 is inserted between the outer shell 13 (more specifically, the inner peripheral surface of the lower rim member 14), and the outer peripheral surfaces of the neck pads 24*a* and 24*b*, the outer peripheral surface of the head backing member 22 and outer surface of the backing member 23 for the chin and cheeks starting with its upper end substantially upward from substantially below. This insertion can be performed until the proximal end of the flexible cover member 53 abuts against the lower end of the lower rim member 14 or the lower end of the stabilizer 21 and is position-regulated, as shown in FIG. 7. In this state, the elastic to-be-attached member 52 is contact-bonded between the inner peripheral surface of the lower rim member 14 or the inner peripheral surface of the stabilizer 21, and the outer peripheral surface of the impact-on-the-head absorbing liner 25. For this purpose, the elastic to-be-attached member 52 and accordingly the neck cover 51 are attached to the head protecting body 3 so as not to drop easily. When removing the neck cover 51 from the head protecting body 3, the proximal end or the like of the flexible cover member 53 may be held with the hand and strongly pulled downward. In this case, the elastic to-be-attached member 52 is extracted substantially downward through between the inner peripheral surface of the lower rim member 14 or stabilizer 21, and the outer peripheral surface of the head backing member 22 and the outer peripheral surfaces of the neck pads 24*a* and 24*b*.

Figure 3:
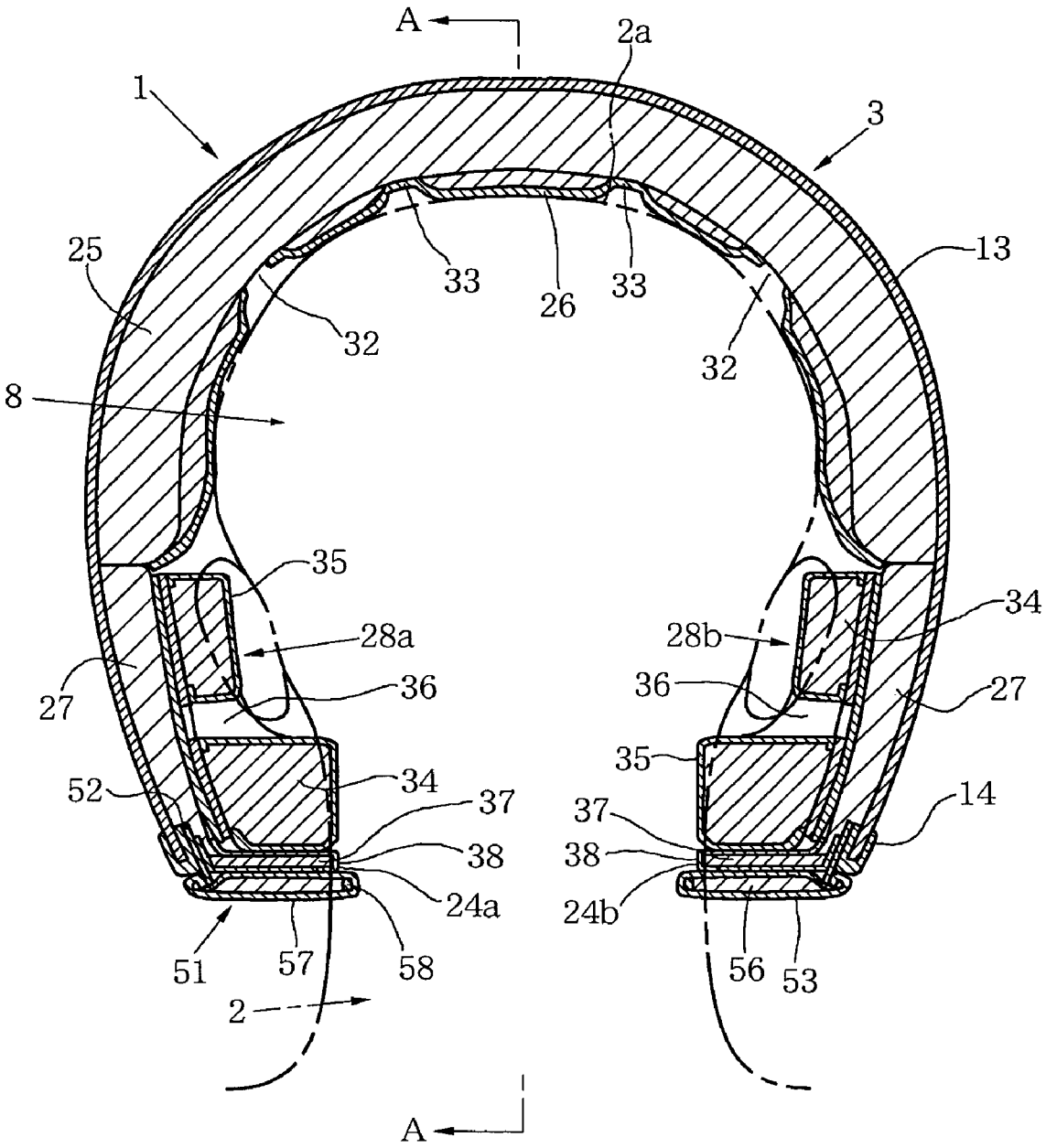
FIG. 3 is a sectional view, taken along the line B-B of FIG. 2, of the full-face-type helmet with the chin cover/neck cover shown in FIG. 1.

In the state shown in FIGS. 17 and 18 as well wherein only the neck cover 51 is attached to the head protecting body 3 of the full-face-type helmet 1, the helmet wearer 2 can put the full-face-type helmet with the neck cover on his head and ride the motorbike. In other words, in the state shown in FIGS. 17 and 18 as well, the full-face-type helmet 1 can be used as a full-face-type helmet with a neck cover. In this case, the flexible cover member 53 covers the neck (excluding the central portion of the front portion of the neck) of the helmet wearer 2 as shown in FIG. 18 (see FIGS. 3 and 4).

The relationship between the lower end face of the full-face-type helmet 1 of the full-face-type helmet with the neck cover shown in FIGS. 17 and 18, and the neck cover 51 shown in FIGS. 13 and 14 will be described with reference to FIG. 5. More specifically, in FIG. 5 (in other words, the embodiment shown in FIG. 5), the proportion of the area of the neck cover 51 (more specifically, the flexible cover member 53) in the area of the lower opening 61 (more specifically, the region surrounded by the inner surface of the lower rim member 14; this applies to the following description) of the outer shell 13 of the full-face-type helmet with the neck cover is about 60% (i.e., about 23,000 $mm^2$). The proportion of the circumferential length L3 (see FIG. 5) of the flexible cover member 53 along the circumference of the lower opening 61 in the circumferential length (L3+L5) of the lower opening 61 of the outer shell 13 is about 86% (i.e., about 620 mm). The inner circumferential length (excluding the left and right end faces 59*a* and 59*b*; this applies to the following description) L4 of the flexible cover member 53 is about 520 mm. In the state shown in FIGS. 13 and 14 wherein the neck cover 51 is not attached to the helmet 1, the inner circumferential length L4 is about 400 mm. Therefore, the proportion of the inner circumferential length L4 of the flexible cover member 53 to the circumferential length (i.e., outer circumferential length) L3 of the flexible cover member 53 along the circumference of the lower opening 61 is about 84%.

From the viewpoint of practice, the various values described above in FIG. 5 generally preferably fall within the numerical ranges described in the following items (12) to (18) according to the present invention. In the items (12) to (18), the numerical ranges in parentheses are further preferable numerical ranges.

(12) The proportion of the area of the flexible cover member 53 in the area of the lower opening 61: 38% to 88% (48% to 74%)

(13) The area of the flexible cover member 53: 14,000 $mm^2$ to 34,000 $mm^2$ (18,000 $mm^2$ to 28,000 $mm^2$)

(14) The proportion of the circumferential length L3 of the flexible cover member 53 along the circumference of the lower opening 61 in the circumferential length (L3+L5) of the lower opening 61: 70% to 94% (80% to 90%)

(15) The circumferential length L3 of the flexible cover member 53 along the circumference of the lower opening 61: 500 mm to 680 mm (580 mm to 650 mm)

(16) The inner circumferential length L4 of the flexible cover member 53: 340 mm to 580 mm (420 mm to 560 mm)

(17) The proportion of the inner circumferential length L4 of the flexible cover member 53 to the outer circumferential length L3 of the flexible cover member 53: 58% to 94% (70% to 88%)

(18) The inner circumferential length L4 of the flexible cover member 53 in a state wherein the neck cover 51 is not attached to the helmet 1: 260 mm to 460 mm (320 mm to 440 mm)

When the helmet wearer 2 puts the full-face-type helmet with the neck cover shown in FIGS. 17 and 18 on his head and rides the motorbike, a traveling wind which blows the chest of the helmet wearer 2 and is directed toward the chin 2*e*, a traveling wind from ahead of the helmet, and other traveling winds are interrupted by the flexible cover member 53 of the neck cover 51 to a considerable degree. Hence, the traveling winds are prevented to a considerable degree from entering the head accommodating space 8 of the full-face-type helmet with the neck cover through the gap between the lower end of the head protecting body 3 and around the neck of the helmet wearer 2. Also, a sound which is generated by the traveling wind as it is caught in the ventilator 18, another ventilator (e.g., a front head and/or back head ventilator which is formed in the outer shell 13 in the vicinity of the boundary between the front head region and/or back head region, and the vertex region), the stabilizer 21, or the like of the full-face-type helmet 1 is interrupted to a considerable degree by the flexible cover member 53 of the neck cover 51. Therefore, the sound generated by the traveling wind is prevented to a considerable degree from entering the head accommodating space 8 of the helmet through the gap between the lower end of the head protecting body 3 and around the neck of the helmet wearer 2.

(iii) How to Attach Both Chin Cover and Neck Cover to Helmet

When attaching both the chin cover 41 shown in FIGS. 11 and 12 and the neck cover 51 shown in FIGS. 13 and 14 to the full-face-type helmet 1 shown in FIGS. 8 to 10, both the operation described in the above item (i) of attaching the chin cover 41, and the operation described in the above item (ii) of attaching the neck cover 51 may be performed. In this case, while the chin cover 41 can be attached first and then the neck cover 51 can be attached, preferably, the neck cover 51 can be attached first and then the chin cover 41 can be attached due to the reason to be described later. As shown in FIGS. 4 and 5, the chin cover 41 can cover the intermittent portion 53*a* of the flexible cover member 53 of the neck cover 51, and in accordance with the attaching procedure of the chin cover 41 and neck cover 51, can cover the left and right front ends of the flexible cover member 53 of the neck cover 51 from the lower or upper side. Hence, as shown in FIG. 4, the lower opening 61 of the outer shell 13 is covered substantially annularly by the chin cover 41 and neck cover 51. When removing the chin cover 41 and neck cover 51 from the head protecting body 3, the cover (e.g., the chin cover 41) which is attached later can be removed first, and then the cover (e.g., the neck cover 51) which is attached first can be removed as described in the above items (i) and (ii).

Figure 1:
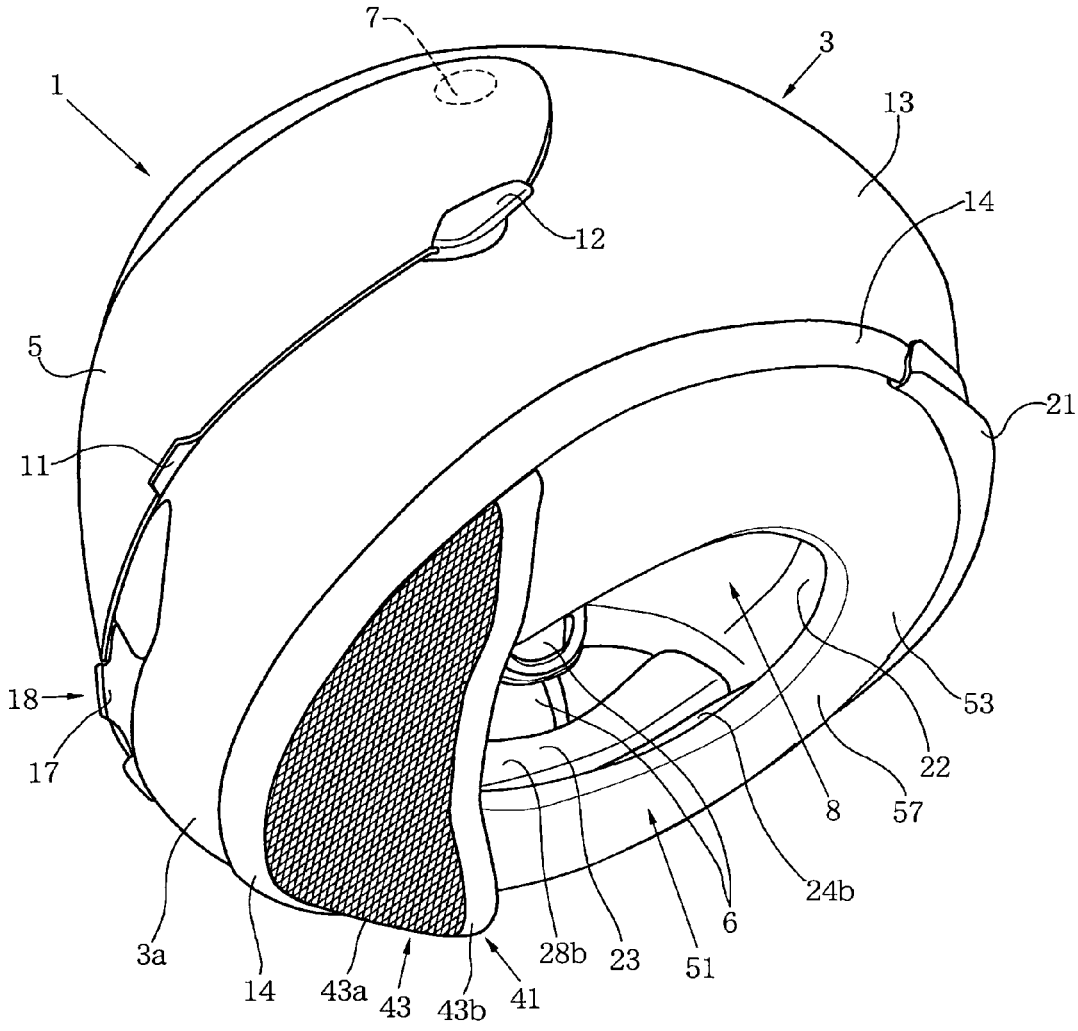
FIG. 1 is a perspective view, seen from obliquely behind and obliquely below, of a full-face-type helmet with a chin cover/neck cover according to an embodiment to which the present invention is applied.
Figure 2:
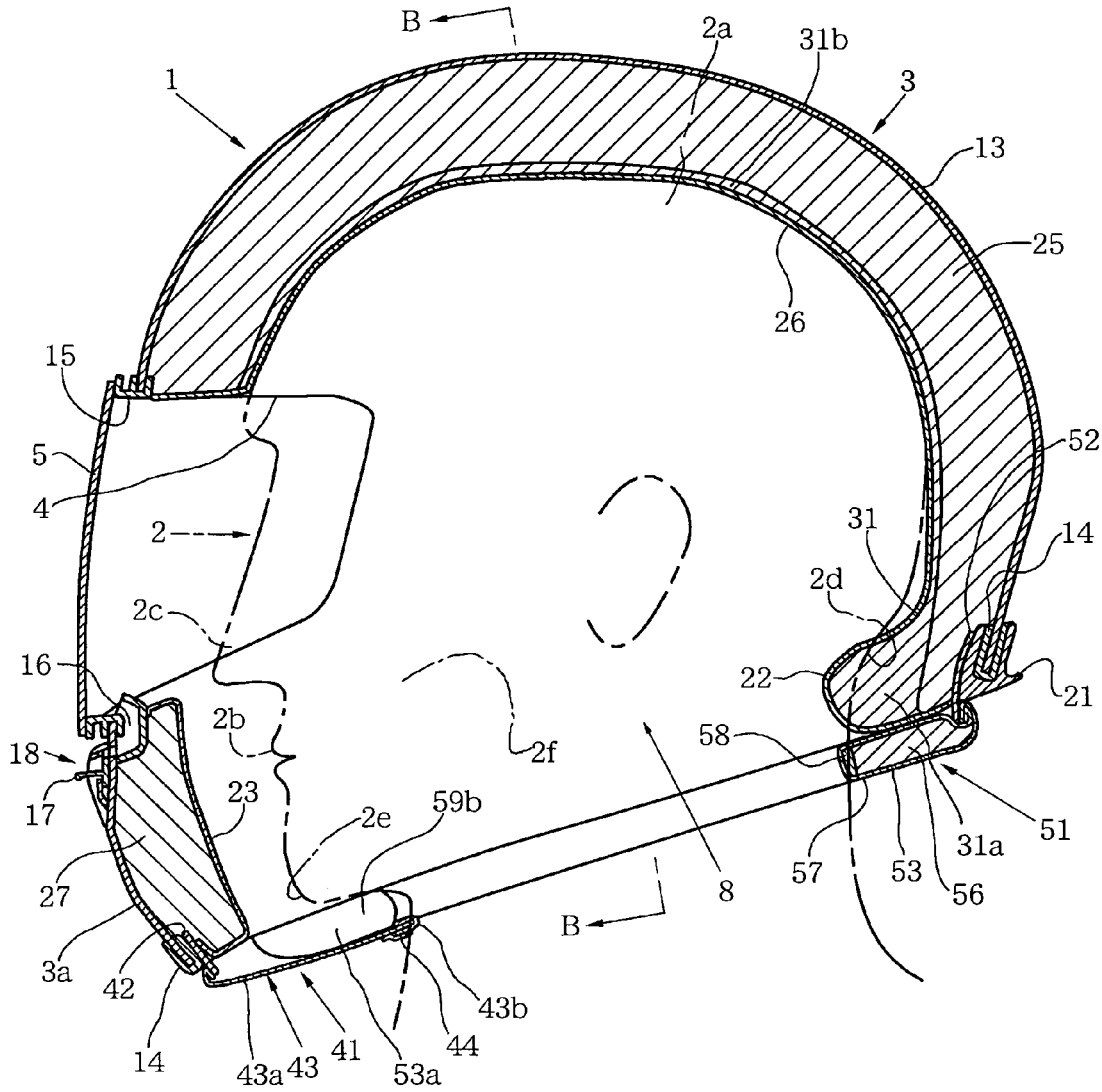
FIG. 2 is a sectional view, taken along the line A-A of FIG. 3, of the full-face-type helmet with the chin cover/neck cover shown in FIG. 1.

In the state shown in FIGS. 1 to 7 wherein both the chin cover 41 and neck cover 51 are attached to the head protecting body 3 of the full-face-type helmet 1, the helmet wearer 2 can put this full-face-type helmet with the chin cover/neck cover on his head and drive the motorbike. In other words, in the state shown in FIGS. 1 to 7, the full-face-type helmet 1 can be used as a full-face-type helmet with a chin cover/neck cover. In this case, the flexible cover member 43 of the chin cover 41 covers the chin 2*e* of the helmet wearer 2 from the lower front portion to the lower portion. The flexible cover member 53 of the neck cover 51 covers the neck (excluding the central portion of the front portion of the neck) of the helmet wearer 2 as shown in FIG. 18 (see FIGS. 3 and 4). Therefore, as shown in FIG. 4 (see FIG. 5), the neck of the helmet wearer 2 is covered substantially entirely by at least one of the chin cover 41 and neck cover 51. If the neck cover 51 is attached to the head protecting body 3 first and then the chin cover 41 is attached, even if the neck cover 51 is thick, in the vicinity of the overlapping portion of the chin cover 41 and neck cover 51, the forward step formed by the thickness of the neck cover 51 does not substantially appear to the outside, as shown in FIG. 2. Therefore, the traveling wind is effectively prevented from relatively colliding against the step.

The relationship between the lower end face of the full-face-type helmet 1 of the full-face-type helmet with the chin cover/neck cover shown in FIGS. 1 to 7, and the chin cover 41 shown in FIGS. 11 and 12 and the neck cover 51 shown in FIGS. 13 and 14 will be described with reference to FIG. 5. More specifically, in FIG. 5 (in other words, the embodiment shown in FIG. 5), the proportion of the area of the flexible cover member 43 (more specifically, that portion of the flexible cover member 43 which does not overlap the flexible cover member 53 of the neck cover 51) of the chin cover 41 in the area of the lower opening 61 (more specifically, the region surrounded by the inner surface of the lower rim member 14; this applies to the following description) of the outer shell 13 of the full-face-type helmet with the chin cover/neck cover is about 11% (i.e., about 4,300 $mm^2$). The proportion of the circumferential length L5 (see FIG. 5) of the flexible cover member 43 (more specifically, that portion of the flexible cover member 43 which does not overlap the flexible cover member 53) along the circumference of the lower opening 61 in the circumferential length (L3+L5) of the lower opening 61 of the outer shell 13 is about 14% (i.e., about 100 mm). The proportion of the area of the flexible cover main body 43*a* (more specifically, that portion of the flexible cover main body 43*a* which does not overlap the flexible cover member 53) of the flexible cover member 43 of the chin cover 41 in the area of the lower opening 61 is about 10% (i.e., about 3,900 $mm^2$). From the viewpoint of practice, the various values described above in FIG. 5 generally preferably fall within the numerical ranges described in the following items (19) to (24) according to the present invention. In the items (19) to (24), the numerical ranges in parentheses are further preferable numerical ranges.

(19) The proportion of the area of that portion of the flexible cover member 43, which does not overlap the flexible cover member 53, in the area of the lower opening 61: 7% to 16% (9% to 13%)

(20) The area of that portion of the flexible cover member 43 which does not overlap the flexible cover member 53: 2,700 $mm^2$ to 6,200 $mm^2$ (3,400 $mm^2$ to 5,200 $mm^2$)

(21) The proportion of the circumferential length L5 of that portion of the flexible cover member 43, which does not overlap the flexible cover member 53, along the circumference of the lower opening 61 in the circumferential length (L3+L5) of the lower opening 61: 6% to 30% (10% to 20%)

(22) The circumferential length L5 of that portion of the flexible cover member 43, which does not overlap the flexible cover member 53, along the circumference of the lower opening 61: 40 mm to 220 mm (70 mm to 140 mm)

(23) The proportion of the area of that portion of the flexible cover main body 43*a*, which does not overlap the flexible cover member 53, in the area of the lower opening 61: 6% to 16% (8% to 14%)

(24) The area of that portion of the flexible cover main body 43*a* which does not overlap the flexible cover member 53: 2,400 $mm^2$ to 5,800 $mm^2$ (3,000 $mm^2$ to 4,800 $mm^2$)

When the helmet wearer 2 puts the full-face-type helmet with the chin cover/neck cover shown in FIGS. 1 to 7 on his head and rides the motorbike, a traveling wind which blows the chest of the helmet wearer 2 and is directed toward the chin 2*e*, a traveling wind from ahead of the helmet, and other traveling winds are largely interrupted by the flexible cover member 53 of the neck cover 51 and the flexible cover member 43 of the chin cover 41. Hence, the traveling winds are largely prevented from entering the head accommodating space 8 of the full-face-type helmet with the chin cover/neck cover through the gap between the lower end of the head protecting body 3 and around the neck of the helmet wearer 2. Also, a sound which is generated by the traveling wind as it is caught in the ventilator 18, another ventilator (e.g., a front head and/or back head ventilator which is formed in the head protecting body 3 in the vicinity of the boundary between the front head region and/or back head region, and the vertex region), the stabilizer 21, or the like of the full-face-type helmet 1 is largely interrupted by the flexible cover member 53 of the neck cover 51 and the flexible cover member 43 of the chin cover 41. Therefore, the sound generated by the traveling wind is largely prevented from entering the head accommodating space 8 of the helmet through the gap between the lower end of the head protecting body 3 and around the neck of the helmet wearer 2.

However, the flexible cover main body 43*a* of the flexible cover member 43 of the chin cover 41 is made of a porous, permeable cloth material. A traveling wind which blows upward in the head accommodating space 8 through the flexible cover main body 43*a* and the like effectively prevents the inner surface of the shield plate 5 from fogging. An external voice and sound also reach the head accommodating space 8 through the flexible cover main body 43*a* and the like. Thus, the helmet wearer 2 can listen to the external voice and sound with a reduced volume.

Figure 19:
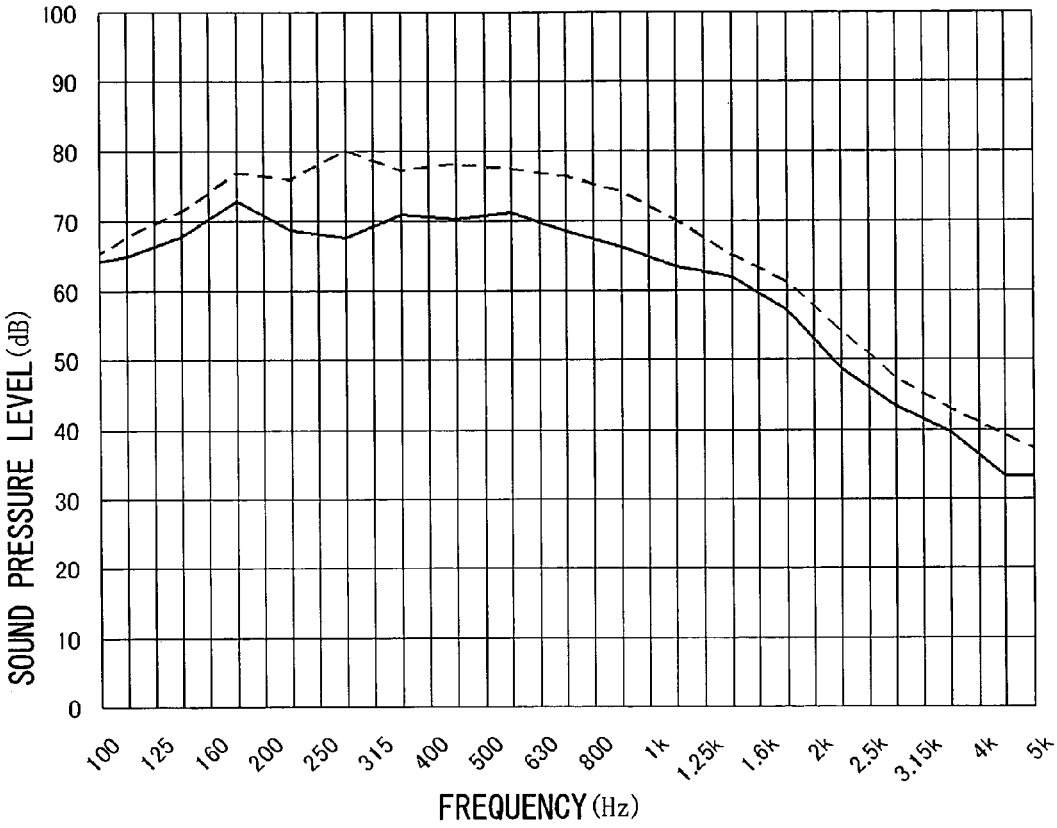
FIG. 19 is a graph showing experimental data in comparison on the full-face-type helmet with the chin cover/neck cover shown in FIG. 1 and the full-face-type helmet shown in FIG. 8.

FIG. 19 shows experimental data in comparison on the full-face-type helmet with the chin cover/neck cover (to be referred to as the "helmet with the covers" hereinafter) shown in FIGS. 1 to 7 and the full-face-type helmet 1 as a single product (to be referred to as "a single-product helmet" hereinafter) shown in FIGS. 8 to 10. In FIG. 19, data indicated by a solid line shows the case of the helmet with the covers, and data indicated by a broken line shows the case of the single-product helmet. The flexible cover main body 43*a* of the flexible cover member 43 of the chin cover 41 is made of double raschel lace.

The experiments the data of which is shown in FIG. 19 were conducted also in manners described in the following items (A) and (B).

(A) A measurement microphone (tie pin type microphone [model No. AT805F] manufactured by Audio-Technica Corporation) was attached near the left ear of a human head model (not shown), and the helmet with covers and the single-product helmet were sequentially mounted on the human head model in turn.

(B) The human head model described in the above item (A) was arranged in a wind tunnel to face forward while it was inclined downward by 15°. A wind with a wind velocity of 100 km/h was blown to the human head model from ahead along the wind tunnel. The frequency characteristics of sound pressure level (dB) were measured from the output current level of the measurement microphone to obtain data on the two helmets shown in FIG. 19.

As a result, as shown in FIG. 19, in the audio frequency range (15 Hz to 20,000 Hz) of the sound waves, particularly between 100 Hz and 5 kHz (5,000 Hz), the sound pressure level (solid line) of the helmet with the covers was considerably lower than the sound pressure level (broken line) of the single-product helmet.

The embodiment of the present invention has been described above in detail. The present invention is not limited to this embodiment, and various changes and modifications can be made based on the spirit of the invention described in the claims.

For example, in the above embodiment, the chin cover 41 and neck cover 51 are attached to the ordinary full-face-type helmet 1. The chin cover 41 and neck cover 51 can also be attached to a full-face-type helmet serving also as a jet type helmet, in which a chin cover 3*a* can be lifted upward.

In the above embodiment, the elastic to-be-attached member 52 and flexible cover member 53 of the neck cover 51 respectively have the intermittent portions 52*a* and 53*a*. The intermittent portions 52*a* and 53*a* are not always necessary, and the elastic to-be-attached member 52 and flexible cover member 53 may have substantially annular shapes with no intermittent portions 52*a* and 53*a*. In this case, preferably, in place of the intermittent portion 53*a*, a notch, e.g., a horizontally elongated notch (i.e., a notch which extends backward from the front end of a substantially annular flexible cover member 53 and/or a notch which extends forward from the rear end) which serves as a missing portion is formed in the front end side and/or rear end side of the central portion of the front portion of the flexible cover member 53, or a hole, e.g., a horizontally elongated hole which serves as a missing portion is formed in the central portion of the front portion of the flexible cover member 53. Then, at the missing portion, at least part of the central portion of the flexible cover member 43 of the chin cover 41 can be prevented from overlapping the flexible cover member 53 of the neck cover 51.

In the above embodiment, each of the to-be-attached portion 42 of the chin cover 41 and the to-be-attached portion 52 of the neck cover 51 is formed of an elastic to-be-attached member which serves as a shape holding member as well. One or both of the to-be-attached portions 42 and 52 need not serve as the shape holding members, and each of them may be another attaching mechanism or part of it, that can attach the chin cover 41 and/or the neck cover 51 to the head protecting body 3 in the state shown in FIGS. 4 and 5. For example, the to-be-attached portion 42 or 52 can be one recess/projection engaging element (e.g., a projection engaging element) of a recess/projection engaging mechanism which attaches the flexible cover member 43 of the chin cover 41 and/or the flexible cover member 53 of the neck cover 51 to the head protecting body 3. In this case, the other recess/projection engaging element (e.g., a recess engaging element) which can engage with one recess/projection engaging element through recess/projection engagement can be provided to the head protecting body 3.

In the present invention, when necessary, a mutual link mechanism which links the left and right side portions of the chin cover 41 with the left and right side portions of the neck cover 51 may be provided. Such a mutual link mechanism can be a recess/projection engaging mechanism as described above.

The invention claimed is:

1. A full-face-type helmet neck cover which is configured to be attached to near a lower end of a head protecting body of a full-face-type helmet, comprising:

a flexible cover member and a to-be-attached portion which serves to attach said flexible cover member to said head protecting body, said flexible cover member comprising a substantially plate-like flexible cushion member which is mainly made of a substantially plate-like foamed synthetic resin, and a flexible support member which supports said flexible cushion member, wherein a permeability of the foamed synthetic resin measured by using a Frajour type method based on JIS L 1096 falls within a range of 0.2 to 5 cc/cm$^2$·sec.

2. A neck cover according to claim 1, characterized in that said flexible support member is made of a substantially non-permeable sheet-type material, and said flexible support member covers said flexible cushion member substantially entirely like a bag.

3. A neck cover according to claim 2, characterized in that said sheet-type material comprises an artificial leather sheet.

4. A neck cover according to claim 1, characterized in that the permeability of the foamed synthetic resin falls within a range of 0.3 to 2 cc/cm$^2$·sec.

5. A neck cover according to claim 1, characterized in that a density of the foamed synthetic resin falls within a range of 30 to 60 kg/cm$^3$, and an average thickness of said flexible cushion member falls within a range of 6 to 12 mm.

6. A neck cover according to claim 5, characterized in that the foamed synthetic resin comprises urethane foam.

7. A neck cover according to claim 5, characterized in that said flexible cushion member is made of only a foamed synthetic resin.

8. A neck cover according to claim 5, characterized in that said to-be-attached portion comprises a substantially plate-like elastic to-be-attached member which serves as a shape holding member as well, and said flexible cover member attached to said to-be-attached member serving as said shape holding member is held in a substantially predetermined shape by said to-be-attached member serving as said shape holding member.

9. A neck cover according to claim 5, characterized in that said flexible cover member has a substantially annular shape with a missing portion which corresponds to substantially a central portion of a front portion of said head protecting body.

10. A neck cover according to claim 9, characterized in that said missing portion comprises an intermittent portion, so that left and right ends of said flexible cover member are present on left and right sides of said intermittent portion.

11. A full-face-type helmet with a neck cover which comprises a full-face-type helmet and a full-face-type helmet neck cover which is configured to be attached to near a lower end of a head protecting body of said full-face-type helmet, comprising:

said neck cover comprises a flexible cover member and a to-be-attached portion which serves to attach said flexible cover member to said head protecting body, said flexible cover member comprising a substantially plate-like flexible cushion member which is mainly made of a substantially plate-like foamed synthetic resin, and a flexible support member which supports said flexible cushion member, and a permeability of the foamed synthetic resin measured by using a Frajour type method based on JIS L 1096 falls within a range of 0.2 to 5 cc/cm$^2$·sec.

12. A helmet according to claim 11, characterized in that the permeability of the foamed synthetic resin falls within a range of 0.3 to 2 cc/cm$^2$·sec.

13. A helmet according to claim 12, characterized in that the foamed synthetic resin comprises urethane foam.

14. A helmet according to claim 12, characterized in that said full-face-type helmet comprises a neck pad attached to near the lower end of said head protecting body, said neck pad comprising a thin plate-like second flexible cushion member and a second flexible support member which supports said second flexible cushion member, said second flexible support member being attached to said head protecting body, said flexible cover member of said neck cover covering said neck pad at least partially from below in an attached state wherein said neck cover is attached to near the lower end of said head protecting body, and said to-be-attached portion of said neck cover is inserted between an inner surface of an outer shell of said head protecting body and an outer, surface of a backing member of said head protecting body substantially upward from substantially below to attach said neck cover to said head protecting body.

15. A helmet according to claim 12, characterized in that in an attached state wherein said neck cover is attached to said head protecting body, a proportion of an area of said flexible cover member in an area of a lower opening of an outer shell of said head protecting body falls within a range of 48% to 74%, in the above attached state, a proportion of a circumferential length of said flexible cover member along a circumference of said lower opening in a circumferential length of said lower opening falls within a range of 80% to 90%, and in the above attached state, a proportion of an inner circumferential length of said flexible cover member to an outer circumferential length of said flexible cover member falls within a range of 70% to 88%.

16. A full-face-type helmet with a chin cover/neck cover comprising:

a full-face-type helmet, a full-face-type helmet neck cover which is configured to be attached to near a lower end of a head protecting body of said full-face-type helmet, and a full-face-type helmet chin cover which is configured to be attached to near the lower end of said head protecting body, characterized in that said neck cover comprises a flexible cover member and a to-be-attached portion which serves to attach said flexible cover member to said head protecting body, said flexible cover member comprising a substantially plate-like flexible cushion member which is mainly made of a substantially plate-like foamed synthetic resin, and a flexible support member which supports said flexible cushion member, a permeability of the foamed synthetic resin measured by using a Frajour type method based on JIS L 1096 falls within a range of 0.2 to 5 cc/cm$^2$·sec, said flexible cover member having a missing portion which corresponds to substantially a central portion of a front portion of said head protecting body, said chin cover comprises a second flexible cover member having a porous, permeable flexible cover main body, and a second to-be-attached portion which serves to attach said second flexible cover member to near the lower end of said head protecting body, and in an attached state wherein both said neck cover and said chin cover are attached to near the lower end of said head protecting body, said neck cover overlaps both left and right ends of said chin cover, and at the missing portion, the substantially central portion of said second flexible cover member of said chin cover does not overlap said flexible cover member of said neck cover.

17. A helmet according to claim 16, characterized in that the permeability of the foamed synthetic resin falls within a range of 0.3 to 2 cc/cm$^2$·sec.

18. A helmet according to claim 17, characterized in that the foamed synthetic resin comprises urethane foam.

19. A helmet according to claim 17, characterized in that said flexible cover main body of said second flexible cover member is made of mesh cloth.

20. A helmet according to claim 17, characterized in that said missing portion comprises an intermittent portion, and in an attached state wherein both said neck cover and said chin cover are attached to near the lower end of said head protecting body, left and right ends of said neck cover respectively overlap left and right ends of said chin cover.

21. A helmet according to claim 17, characterized in that said second to-be-attached portion comprises a substantially plate-like elastic second to-be-attached member which also serves as a second shape holding member, said second flexible cover member attached to said second to-be-attached member which also serves as said second shape holding member is held in a substantially predetermined shape by said second to-be-attached member which also serves as said second shape holding member, and said second to-be-attached portion of said chin cover is inserted between an inner surface of an outer shell of said head protecting body and an outer surface of a backing member of said head protecting body substantially upward from substantially below to attach said chin cover to said head protecting body.

22. A helmet according to claim 17, characterized in that said second flexible cover member has a wide, substantially crescent-like shape which is substantially close to a half moon, and said second flexible cover member comprises said flexible cover main body and a flexible rim member attached to said flexible cover main body.

23. A helmet according to claim 17, characterized in that in an attached state wherein said chin cover is attached to said head protecting body, a proportion of an area of said second flexible cover member in an area of a lower opening of an outer shell of said head protecting body falls within a range of 18% to 28%, and in the above attached state, a proportion of a circumferential length of said second flexible cover member along a circumference of said lower opening in a circumferential length of said lower opening falls within a range of 34% to 46%.

24. A helmet according to claim 17, characterized in that in an attached state wherein said chin cover is attached to said head protecting body, a proportion of an area of said flexible cover main body of said second flexible cover member in an area of a lower opening of an outer shell of said head protecting body falls within a range of 12% to 22%, and in the above attached state, a proportion of a circumferential length of said flexible cover main body along a circumference of said lower opening in a circumferential length of said lower opening falls within a range of 30% to 42%.

25. A helmet according to claim 17, characterized in that in an attached state wherein both said chin cover and neck cover are attached to said head protecting body, a proportion of an area of a portion of said second flexible cover member, which does not overlap said flexible cover member, in an area of a lower opening of an outer shell of said head protecting body falls within a range of 9% to 13%, and in the above attached state, a proportion of a circumferential length of a portion of said second flexible cover member, which does not overlap said flexible cover member, along a circumference of said lower opening in a circumferential length of said lower opening falls within a range of 10% to 20%.

26. A helmet according to claim 17, characterized in that in an attached state wherein both said chin cover and neck cover are attached to said head protecting body, a proportion of an area of a portion of said flexible cover main body of said second flexible cover member, which does not overlap said flexible cover member, in an area of a lower opening of an outer shell of said head protecting body falls within a range of 8% to 14%.

* * * * *